US008707504B2

(12) United States Patent
Ryan

(10) Patent No.: US 8,707,504 B2
(45) Date of Patent: Apr. 29, 2014

(54) HYGIENIC TOOTHBRUSH AND METHOD OF USING SAME

(76) Inventor: Patrick Clarkson Ryan, Newport, RI (US)

( * ) Notice: Subject to any disclaimer, the term of this patent is extended or adjusted under 35 U.S.C. 154(b) by 469 days.

(21) Appl. No.: 13/065,171

(22) Filed: Mar. 16, 2011

(65) Prior Publication Data

US 2011/0247656 A1 Oct. 13, 2011

Related U.S. Application Data

(63) Continuation-in-part of application No. 12/734,706, filed as application No. PCT/US2008/088259 on Dec. 23, 2008, now abandoned.

(60) Provisional application No. 61/016,487, filed on Dec. 23, 2007, provisional application No. 61/188,926, filed on Aug. 14, 2008.

(51) Int. Cl.
*A46B 17/04* (2006.01)

(52) U.S. Cl.
USPC ..... 15/185; 15/184; 132/308; 132/311

(58) Field of Classification Search
USPC ..... 15/167.1, 184–185; 132/308, 311; 134/6, 18
See application file for complete search history.

(56) References Cited

U.S. PATENT DOCUMENTS 543,028 A 7/1895 Laws
1,503,134 A 7/1924 Ryan
1,960,807 A 5/1934 Cole
2,651,070 A 9/1953 Zimmerman
4,214,657 A 7/1980 Winston
4,234,087 A 11/1980 Pandak
4,275,750 A 6/1981 Clark
4,396,238 A 8/1983 Torruella
4,408,920 A 10/1983 Walther
4,421,433 A 12/1983 Villanueva
4,585,119 A 4/1986 Boyinaton
4,780,923 A 11/1988 Schultheiss
4,816,648 A 3/1989 Dusbabek
4,835,813 A 6/1989 Lorenzana et al.
4,845,859 A 7/1989 Evans
4,866,809 A 9/1989 Pelletier
4,888,487 A 12/1989 Ritter
4,924,547 A * 5/1990 Wachtel et al. ..... 15/185
4,997,629 A 3/1991 Marchand
5,003,658 A 4/1991 Rolleri
5,023,460 A 6/1991 Foster et al.
5,044,039 A 9/1991 Picard
5,044,386 A 9/1991 Nelson
5,048,144 A 9/1991 Andrews
5,052,556 A 10/1991 Wilkinson
5,086,916 A 2/1992 Gray
5,107,987 A 4/1992 Palazzolo
(Continued)

FOREIGN PATENT DOCUMENTS

GB 2223398 A * 4/1990
WO WO 90/12522 A1 * 11/1990

*Primary Examiner* — Laura C Guidotti
(74) *Attorney, Agent, or Firm* — Michael de Angeli

(57) ABSTRACT

A hygienic toothbrush comprises a bristle cover movably secured to the elongated body of the toothbrush to protect the bristles of the toothbrush when it is not being used. A storage compartment with a removable lid is provided in the handle of the toothbrush body for storing the cover when not in use.

42 Claims, 22 Drawing Sheets

(56) References Cited

U.S. PATENT DOCUMENTS

| | | | | |
|---|---|---|---|---|
| 5,126,572 | A | | 6/1992 | Chu |
| 5,127,521 | A | | 7/1992 | Borque |
| 5,139,142 | A | | 8/1992 | Simon |
| D343,296 | S | | 1/1994 | Schneider |
| 5,333,742 | A | | 8/1994 | Piedmont |
| D351,286 | S | | 10/1994 | Tapocik |
| 5,382,107 | A | | 1/1995 | Nian |
| 5,464,294 | A | | 11/1995 | Chee |
| 5,476,333 | A | | 12/1995 | Matthews |
| 5,505,301 | A | | 4/1996 | Foley |
| 5,735,298 | A | | 4/1998 | Mayne |
| 5,771,521 | A | | 6/1998 | McNamee |
| 5,779,046 | A | | 7/1998 | Plakos |
| 5,832,940 | A | | 11/1998 | Embry et al. |
| 5,882,613 | A | | 3/1999 | Gipson |
| 5,887,601 | A | * | 3/1999 | King ..... 132/311 |
| 5,924,567 | A | | 7/1999 | Wenum |
| 5,960,801 | A | | 10/1999 | Vermooten |
| 6,026,532 | A | | 2/2000 | Catanzaro |
| 6,099,813 | A | | 8/2000 | Gipson |
| 6,102,203 | A | | 8/2000 | Marro |
| 6,119,854 | A | | 9/2000 | Prentice |
| 6,129,090 | A | | 10/2000 | Pillar et al. |
| 6,171,559 | B1 | | 1/2001 | Sanders |
| 6,560,810 | B1 | | 5/2003 | Jacobson |
| 6,671,920 | B2 | | 1/2004 | Pearlman et al. |
| 7,168,121 | B2 | | 1/2007 | Rehkemper |
| 7,246,400 | B2 | * | 7/2007 | Ryan ..... 15/185 |
| 7,310,848 | B2 | * | 12/2007 | Lepoittevin et al. ..... 15/185 |

* cited by examiner

HYGIENIC TOOTHBRUSH AND METHOD OF USING SAME

CROSS-REFERENCE TO RELATED APPLICATION

This application is a continuation-in-part of U.S. patent application Ser. No. 12/734,706, filed May 19, 2010 which was a continuation-in-part of PCT application PCT/US2008/088259, filed 23 Dec. 2008, which claimed priority from provisional application Ser. Nos. 61/016,487, filed Dec. 23, 2007, and 61/188,926, filed Aug. 14, 2008.

FIELD OF THE INVENTION

The present invention relates generally to hygienic toothbrushes and methods of hygienically using the toothbrushes to clean a person's teeth. More specifically, the present invention relates to hygienic toothbrushes having accessories and methods of using the accessories to protect surfaces of the toothbrushes from microbes, including bacteria, fungi, and protozoan parasites, and from viral or other airborne contamination.

BACKGROUND OF THE INVENTION

Toothbrushes have been used for many years to clean one's teeth. Only in the more recent past has the importance of a sanitary brush become well known. Toothbrushes are often stored in the bathroom and a bathroom can be a very unclean place. Even if it appears to be clean on the surface, airborne contaminants, viral agents, and bacterial agents abound and thrive under such conditions. These airborne contaminants (e.g. fecal material from a flushed toilet), bacterial and viral agents can be the cause of illness and disease.

There is a need for a hygienic toothbrush that is economical, easily used, and effective in prevention of microbial, viral, or airborne contamination.

The present inventor discloses in U.S. Pat. No. 7,246,400 a hygienic toothbrush provided with a cover to keep the bristles of the brush clean when not in use. The cover is affixed to the handle of the toothbrush, so as to be movable between a first position in which it covers the bristles and a second position in which the bristles are exposed so that the brush can be employed for cleaning one's teeth. In the second position the cover is received in a storage compartment in the handle. The present invention relates to further improvements on the toothbrush disclosed therein.

SUMMARY OF THE INVENTION

According to the present invention, the toothbrush disclosed in the prior patent of the present inventor is further improved upon in several distinct aspects. A first of these is to provide a lid for the storage compartment for the bristle cover in the handle of the toothbrush, so as to prevent contaminants from settling on the cover when the brush is in use. Several embodiments of brushes providing this additional level of contamination protection are disclosed herein. Other improvements are also disclosed herein.

According to a first aspect of the present invention, a toothbrush assembly is provided comprising an elongated toothbrush body having a bristle head at one end and a handle at a second end, the handle comprising a storage compartment, the storage compartment comprising a lid, wherein the lid is operably coupled to the storage compartment; a cover having an open side enabling the cover to be placed over the bristles;

an elongated connector comprising a first end operably coupled to the toothbrush body between the bristled head and the storage compartment and a second end operably coupled to the cover, whereby the cover is movable between a first position, in which the cover is disposed over the bristles to protect them when not in use, and a second position, in which the cover is protected within the storage compartment when the brush is in use; and means for selectively retaining the cover in the first and second positions.

According to a second aspect of the present invention, a toothbrush assembly is provided comprising an elongated toothbrush body having a bristle head at one end and a handle at a second end, the handle comprising a storage compartment, the storage compartment comprising a lid, wherein the lid is operably coupled to the storage compartment; and a cover for the bristles, the cover being movable between a first position, in which the cover is disposed over the bristles to protect them when not in use, and a second position, in which the cover is disposed within the storage compartment and protected by the lid of the storage compartment when the brush is in use.

According to a third aspect of the present invention, a method for hygienically cleaning the teeth of a person is provided, comprising the steps of providing a toothbrush assembly comprising an elongated toothbrush body, having a bristle head at one end and a handle at a second end, the handle comprising a storage compartment, the storage compartment comprising a lid, the lid being operably coupled to the storage compartment; covering the bristles when the toothbrush is not in use with a cover to protect them from microbial, viral, or airborne contaminants, and sealing the cover in the storage compartment when the brush is in use, wherein the cover is cleaned to remove any microbial, viral, or other airborne contaminants before sealing it in the storage compartment.

According to a fourth aspect of the present invention, a toothbrush assembly is provided comprising an elongated toothbrush body having a bristle head at one end and a handle at a second end, a bristle cover, the handle comprising a storage compartment for receiving the bristle cover when the brush is in use, the storage compartment defining an opening extending from a first surface to an opposite surface, wherein the first and second surfaces are in parallel planes, and having a replaceable lid fitting flush with the first surface over the opening to close it, an elongated connector including a first end pivoted to the toothbrush body between the bristle head and the opening, and a second end operably coupled to the cover, whereby the cover is movable between a first position, in which the cover is disposed over the bristles to protect them when not in use, and a second position, wherein the cover is disposed in the opening in the handle, the opening then being closed by the replaceable lid, so that the cover may be protected from environmental contaminants when the brush is in use; and means for selectively retaining the cover in the first and second positions. The cover is generally a box having an open side for receiving the bristles, to protect them. The cover and elongated connector are preferably arranged so that the open face of the cover is disposed toward the bottom of the storage compartment when disposed therein.

According to a fifth aspect of the present invention, a toothbrush is provided comprising an elongated toothbrush body, having first and second ends, and having a first surface, a bristle head operably coupled to the first surface of the elongated toothbrush body at the first end of the elongated toothbrush body, a storage compartment in the second end of the elongated toothbrush body, wherein the storage compartment is defined by lateral walls and a bottom surface, a protective bristle cover to be placed over the bristles, an elongated connector having a first end pivoted to the toothbrush body between the bristle head and the opening, and a second end operably coupled to the protective bristle cover, so that the protective bristle cover is movable between a first position and a second position, such that in the first position, the protective bristle cover encloses the bristles to protect them when not in use, and in the second position the bristle cover is disposed in the storage compartment such that an open face of the protective bristle cover faces the bottom surface of the storage compartment.

According to a sixth aspect of the present invention, a method of protecting the bristles of a toothbrush is provided, comprising the steps of providing an elongated toothbrush body having first and second ends and a first surface therebetween, a bristle head on the first surface of the elongated toothbrush body at the first end of the elongated toothbrush body, a storage compartment in the second end of the elongated toothbrush body, the storage compartment being defined by lateral walls and a bottom, a protective bristle cover to be placed over the bristles, an elongated connector having a first end pivoted to the toothbrush body between the bristled head and the storage compartment, and a second end operably coupled to the protective bristle cover, so that the protective bristle cover is movable between a first position and a second position, wherein in the first position, the protective bristle cover encloses the bristles to protect them when not in use, and wherein in the second position the bristle cover is disposed in the storage compartment. Preferably, an open face of the protective bristle cover faces the bottom of the storage compartment when in the second position. The elongated connector is pivoted about an axis fixed with respect to the body of the toothbrush in order to move the protective bristle cover from the first position covering the bristles to the second position in the storage compartment. The axis about which the elongated connector pivots may be transverse with respect to the body of the toothbrush, in which case the bristle cover must also be pivoted to the elongated connector so that the open face of the bristle cover can face the bottom of the storage compartment when disposed therein, or may be perpendicular to the body of the toothbrush, in which case the cover can be formed integrally with the elongated connector.

The toothbrush of the invention may also comprise an ultrasonic actuator for vibrating the bristles, to get better cleaning action. The cover may also incorporate a source of ultraviolet radiation, to sterilize the bristles.

BRIEF DESCRIPTION OF THE DRAWINGS

The invention will be better understood if reference is made to the accompanying drawings, in which.

DESCRIPTION OF THE PREFERRED EMBODIMENTS OF THE INVENTION

Figure 1:
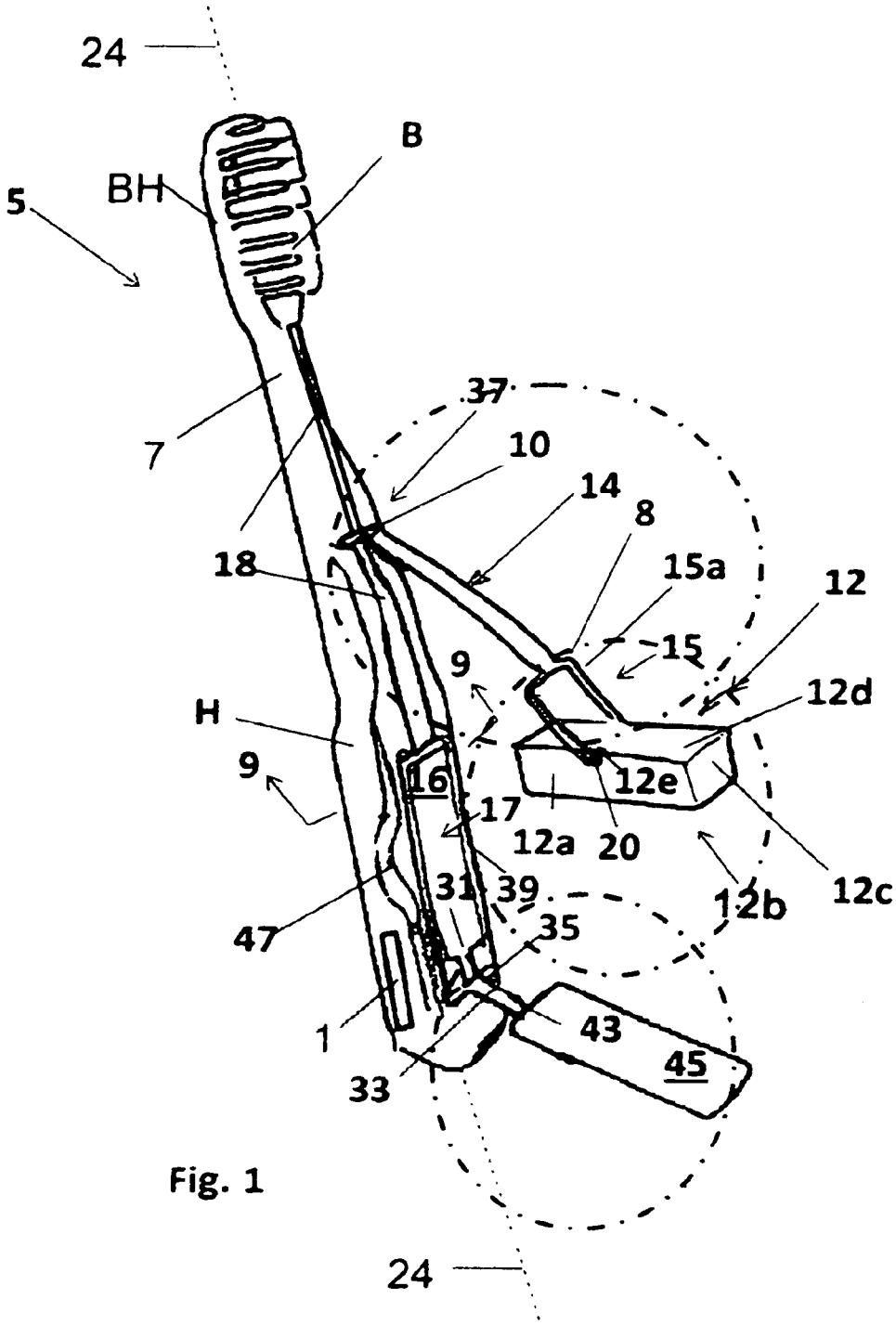
FIG. 1 depicts a front elevation view of a toothbrush assembly having a lid operably coupled to a storage compartment.

It is an object of this invention to provide a toothbrush made hygienic by protecting the bristles of the brush from coming in contact with harmful contaminants, including bacteria, microbes, fungi, protozoan parasites, viral agents, or other contaminants, e.g. fecal contaminants, when the brush is not in use. This object is accomplished by provision of a protective cover that prevents contaminants from settling on the brush bristles when the brush is not in use, and is further accomplished by provision of a closable storage compartment in which the cover is stored while the brush is in use, protecting the cover itself from such contaminants. It is recommended (but not necessary) that the brush head be rinsed in an antiseptic/antibacterial solution (such as Listerine®) prior to placing the cover over the bristles to kill any bacterial/viral agents transferred from the user's mouth. This procedure used in combination with the present invention will result in potential health benefits. Still another related advantage is that the present hygienic toothbrush with cover solves a major health concern in that it also prevents contamination by insects. The common housefly and other disease carrying insects love to frequent bathrooms.

It is another object of this invention to provide the toothbrush with a hollow storage compartment with lid that remains assembled to the toothbrush for hygienically storing the cover when the toothbrush is in use. Because the hollow storage compartment with lid is permanently adjoined to the toothbrush, it is much more likely to be used on a consistent basis. The cover may be protected from coming in contact with harmful contaminants while the brush is in use by placing the cover in the hollow storage compartment and closing the lid. Again, it is recommended (but not necessary) that the cover and hollow storage compartment be rinsed with an antiseptic/antibacterial solution (such as Listerine®) prior to placing the cover in the hollow storage compartment to kill any bacterial/viral agents transferred from the user's mouth. This procedure used in combination with the present invention will result in potential health benefits.

The hygienic toothbrush with cover of the invention is constructed principally of various plastic materials. The cover may include mesh side panels of a fibrous woven or mesh-like plastic material, so as to allow the bristles to dry after use.

As noted, it is an object of the invention to provide a toothbrush with a hollow storage compartment and lid that are assembled to the remainder of the toothbrush. The toothbrush cover is readily maneuvered into the hollow storage compartment in the brush handle for temporary storage during brushing. When the user is finished brushing, the brush cover is similarly readily maneuvered to cover and protect the bristles. An advantage of designing the toothbrush and hollow storage compartment with a lid that is not detached from the toothbrush in use is that the hollow storage compartment will be more likely to be used to hygienically store the cover. Storing the cover, for example, in a separate storage compartment with lid may result in the cover being lost, rendering it ineffective.

It is another object of the inventor to prevent cross contamination between toothbrushes stored in close proximity. Toothbrushes in a conventional toothbrush holder are often in close contact with one another. Even the briefest contact can cause a transmission of harmful contaminants from one brush head to another. A family member that is sick or "coming down with something" can easily contaminate another family member's brush with harmful bacterial or viral agents. The hygienic toothbrush of the invention with hollow storage compartment and lid prevents this contact and therefore prevents the transmission of these agents and illness associated with them.

It is still another object of the invention to produce a hygienic toothbrush that is space efficient. The hygienic toothbrush of the invention, with bristle cover, hollow storage compartment, and lid is constructed in such a way that the cover is spacious enough so that the bristles do not contact the inner surface of the cover when in a closed position, thereby inhibiting bacterial growth, yet is small enough so that it fits within the hollow storage compartment with lid in the handle structure, completely out of the way, when in use brushing a user's teeth.

Other objects, features, and advantages will become obvious to those skilled in the art from the following descriptions and accompanying drawings.

FIGS. 1-9 and 14-16 depict a first embodiment of a toothbrush assembly according to the invention. The toothbrush assembly 5 comprises an elongated toothbrush body 7 having a bristle head BH at one end and a handle H at a second end. The handle H comprises a storage compartment 16 for receiving a bristle cover 12. A lid 45 for covering the hollow storage compartment 16 is operably coupled to handle H. In the embodiment of FIG. 1, a recess 47 is provided adjacent and below the lid 45 for insertion of a user's finger or alternatively a lever to pry open the lid 45. The lid 45 may be provided as a separate element, as shown, or may be formed by the back side 12*d* of the cover 12, the cover 12 having an open face 12*b* enabling the cover 12 to be placed over the bristles B.

The toothbrush 5 is constructed principally of various plastic materials, while ventilated side panels 12*a* of the cover 12 may be constructed of a fibrous woven or mesh plastic material.

Figure 2:
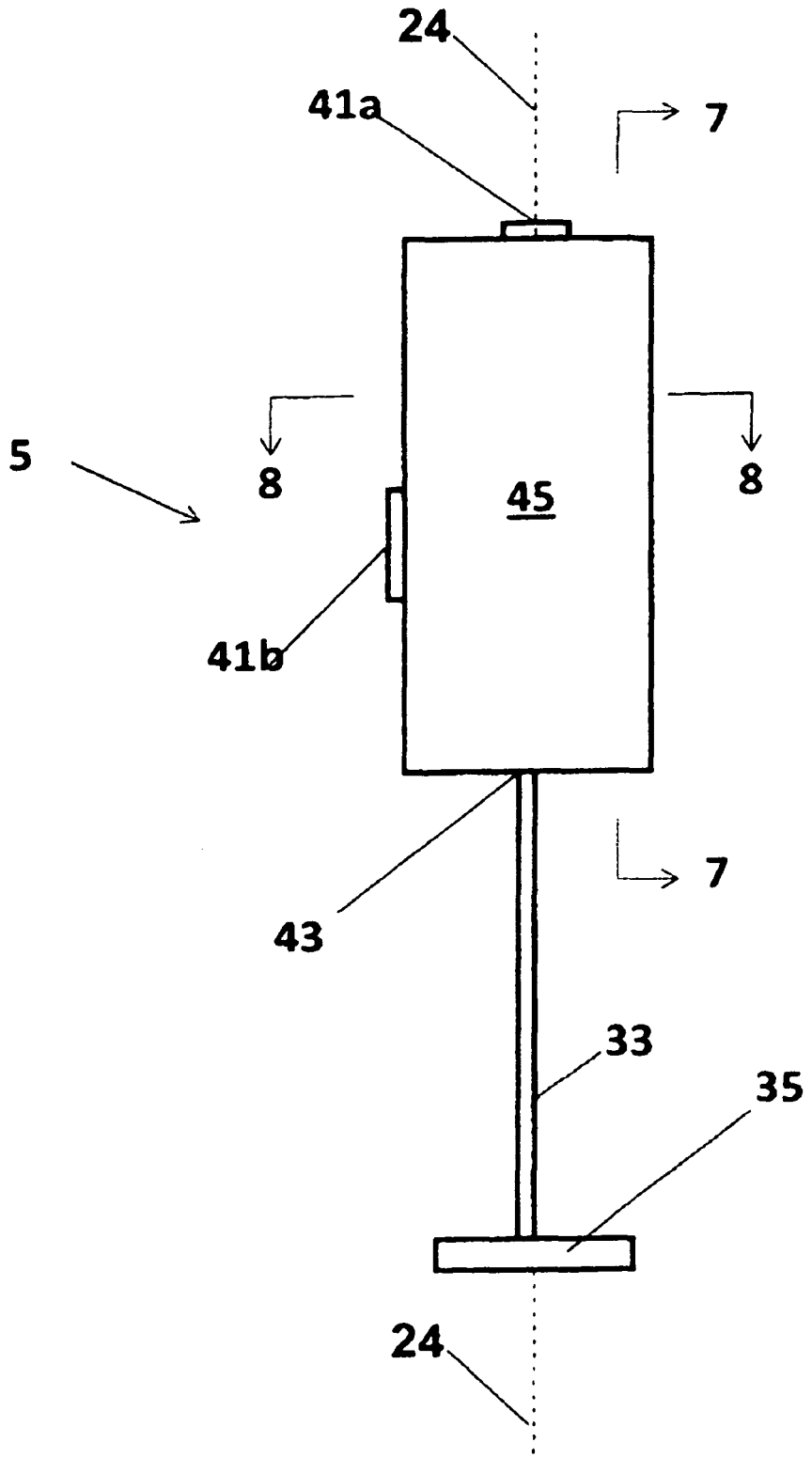
FIG. 2 depicts a top plan view of a storage compartment lid of a toothbrush assembly.
Figure 3:
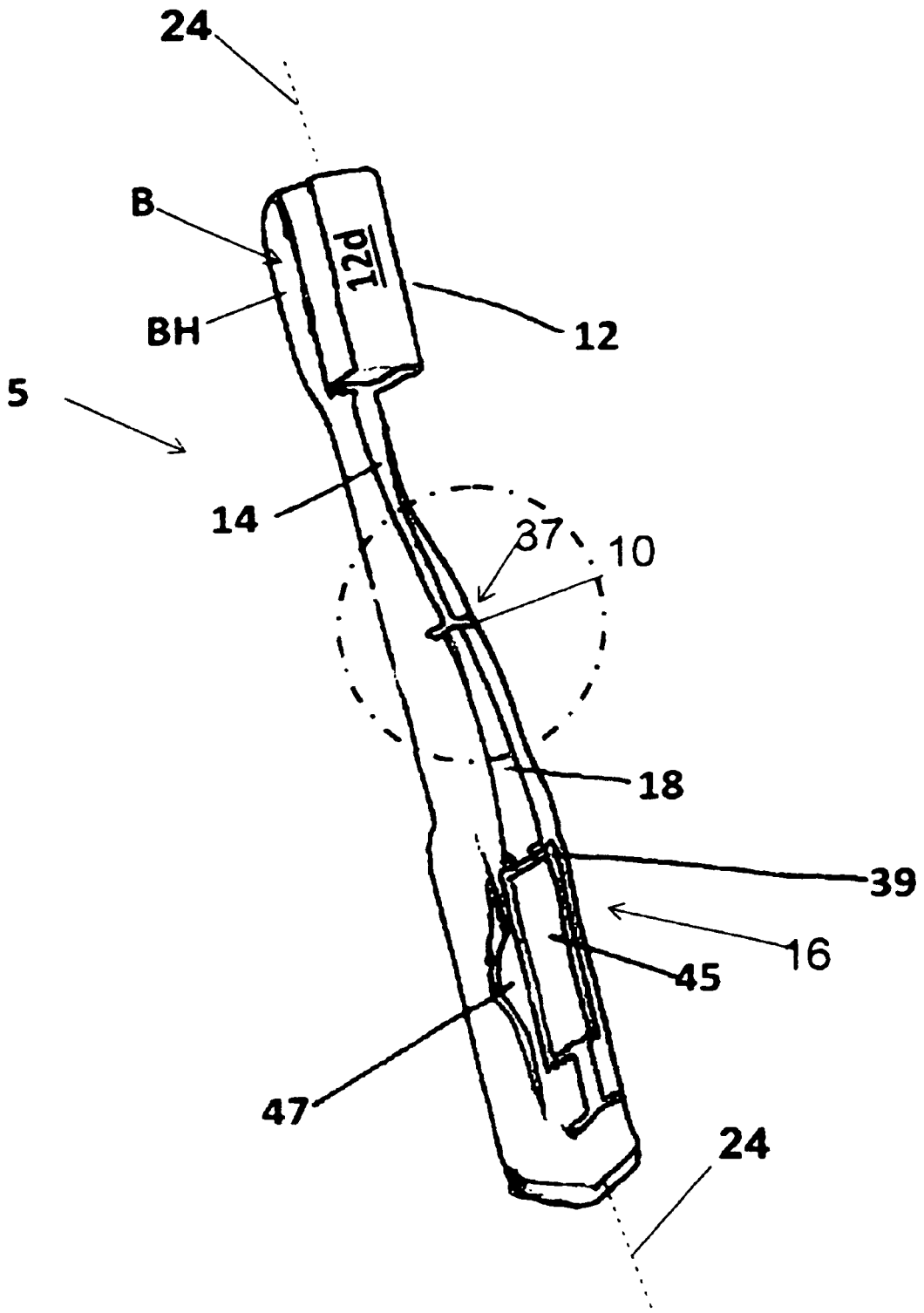
FIG. 3 depicts a side elevation view of a toothbrush assembly having a covered brush head and covered storage compartment.

In the embodiment of FIGS. 1-9 and 14-16, the toothbrush assembly 5 comprises an elongated connector 14 comprising a first end 37 operably coupled to the elongated toothbrush body 7 at a point between the bristled head BH and the hollow storage compartment 16 and a second end 8 operably coupled to the cover 12, whereby the connector 14 can be moved so as to move cover 12 between a first closed position (as depicted in FIG. 3), in which the cover 12 is disposed over the bristles B to protect them when not in use, and a second open position (depicted in FIG. 4) in which the cover 12 is protected within the storage compartment 16 when the brush 5 is in use. In the embodiment shown, a first end of elongated connector 14 comprises a transverse pin 37 that is received by a snap-fit into a transverse groove 10 in the toothbrush body 7 (see FIGS. 5 and 6), so that the elongated connector 14 can be pivoted about an axis transverse to the direction of elongation of the toothbrush, moving cover 12 between the first and second positions. The connector 14 may be molded as a single piece, including transverse pin 37 and means for attachment to cover 12.

Figure 14:
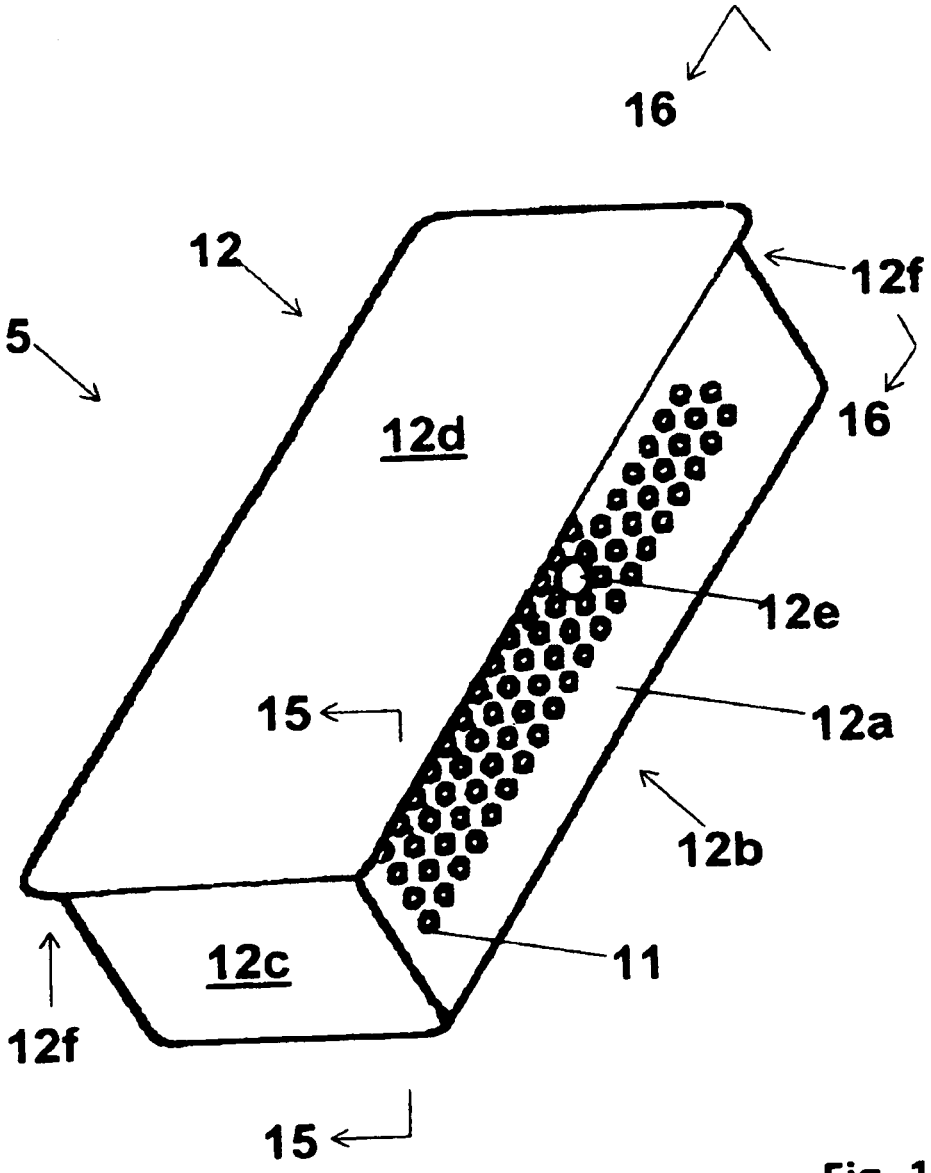
FIG. 14 depicts an elevation view of a cover for a toothbrush assembly.

As illustrated in FIG. 1 and in more detail by FIG. 14, the cover 12 is generally box-shaped, including an open face 12*b*, porous sides 12*a*, solid end panels 12*c*, and a solid back panel 12*d*, opposite the open face 12*b*. The two side panels 12*a* are preferably ventilated to allow drying of the bristles after use, by perforations as shown at 11, or by provision of mesh or woven inserts. Ventilation is provided to expose maximum bristle surface area to the air, while minimizing the possibility of contamination of the bristle head BH. The two end panels 12*c* are of substantially solid construction, that is, are not ventilated. The back panel 12*d* is solid to prevent contaminants from infiltrating, and the opposed face 12*b* is open, in order to receive the bristles.

The bristle head BH, bristles B, and cover 12 may have corresponding round, square, pyramidal, rectangular, rhomboid or other appropriate shapes.

Figure 5:
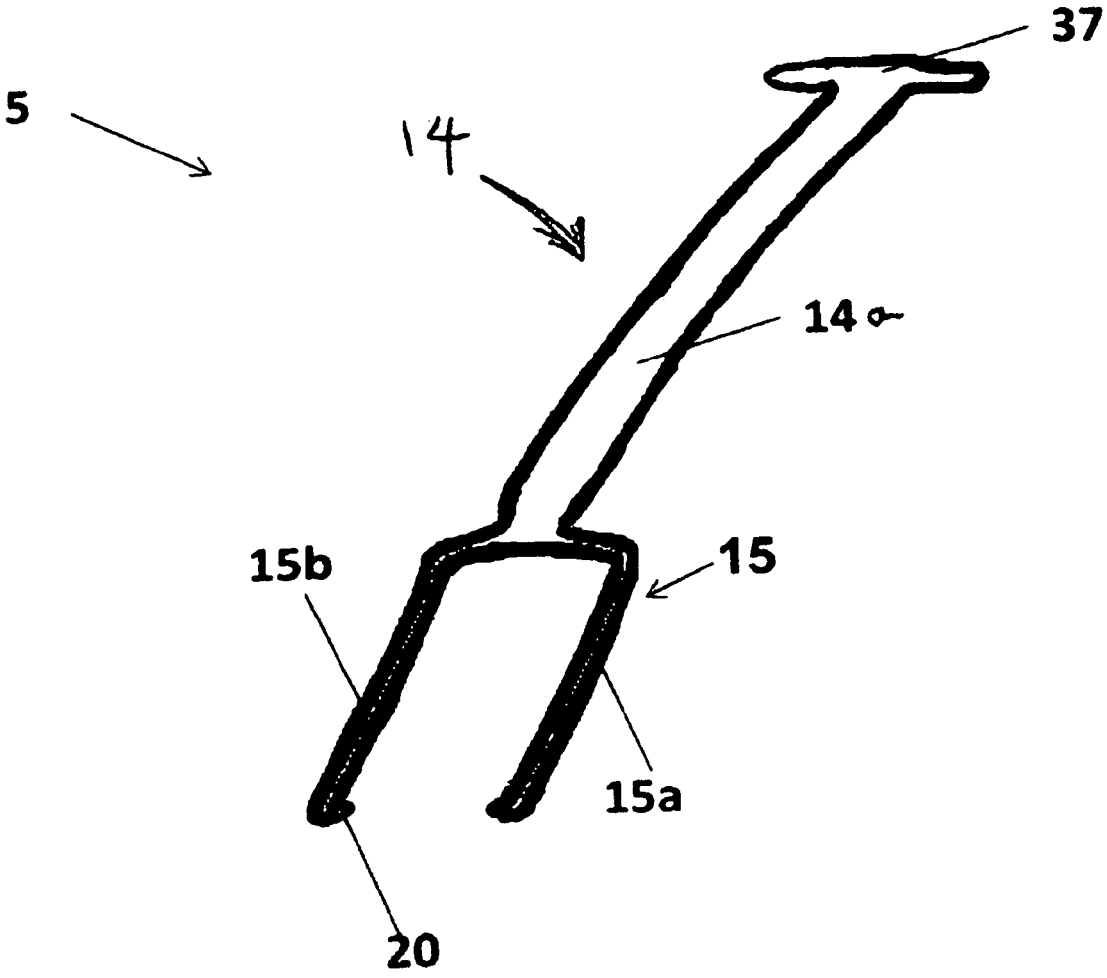
FIG. 5 depicts a connector for connecting a cover to a toothbrush handle.
Figure 6:
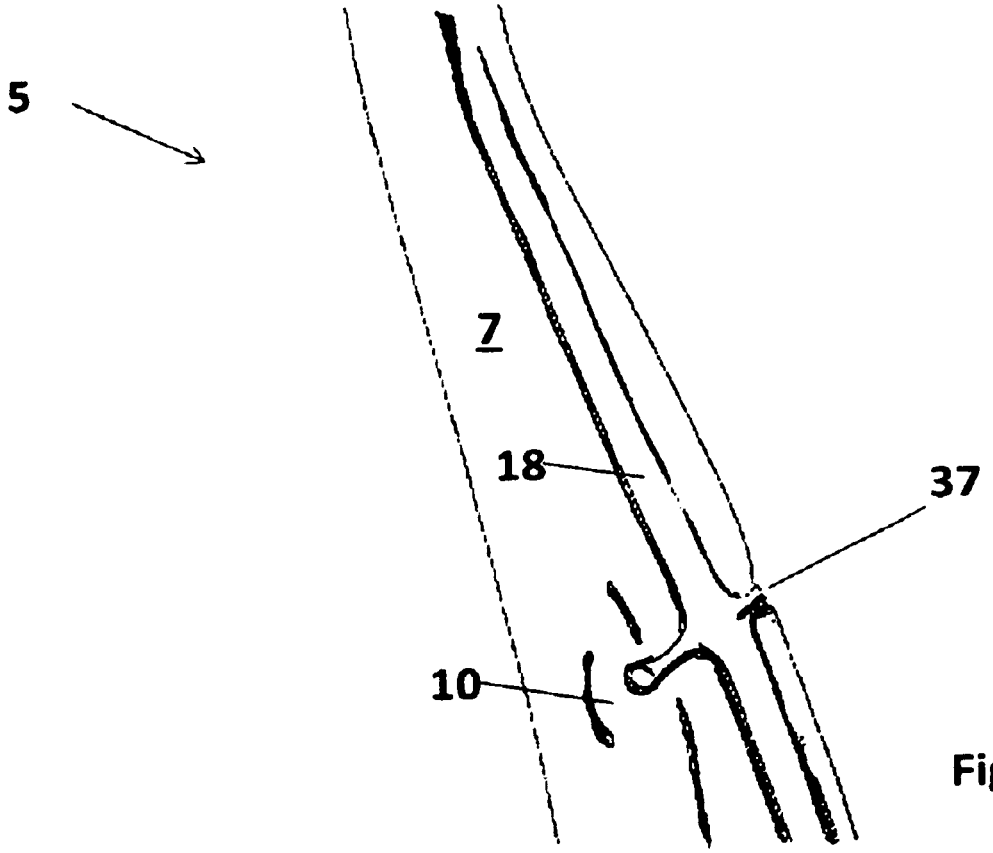
FIG. 6 depicts an expanded side elevation view of a detail of the toothbrush assembly illustrated in FIG. 3.

FIG. 5 depicts an expanded front elevation view of the elongated connector 14 for operably coupling a cover 12 to the toothbrush body 7 of toothbrush 5 shown in FIG. 1. The elongated connector 14 has a first end formed to define a spine 14*a* and a transverse pin 37, and a second end. As above, transverse pin 37 may be a snap-fit into groove 10 in the handle H, permitting elongated connector 14 to be pivoted about an axis transverse to the body of the toothbrush between first and second positions. The second end comprises a bifurcated member 15, having arms 15*a* and 15*b*, each arm 15*a*, 15*b* being terminated with an inwardly-extending compression point or nub 20. The nubs 20 may be inserted into holes 12*e* in the body of the cover 12 (see FIG. 14) so that the cover 12 is free to rotate through 360 degrees with respect to elongated connector 14. Alternatively, the cover may swivel on a pin or axle running between the arms 15*a* and 15*b*. This freedom of motion is provided such that the cover can be pivoted so that its open face faces downwardly, toward the interior of the storage compartment, providing a further measure of protection against contaminant intrusion.

In one embodiment, the toothbrush 5 may include an electric powered sonic vibrator 1, for providing brushing motion when one is using the toothbrush 5 to clean one's teeth. This embodiment is discussed further below in connection with FIG. 26.

The hollow storage compartment 16 is defined by a recess in the handle H, sized to receive the cover 12. The hollow storage compartment 16 may have a peripheral recess 39 for receiving a lid 45, as discussed below.

FIG. 2 depicts a top plan view of a lid 45 for a hollow storage compartment 16 of a toothbrush assembly 5. The lid 45 may be molded integrally with a lid arm 33, joining lid arm 33 at point 43, the lid arm 33 ending in a transverse pin 35, which is received by a snap-fit into a groove 31 formed at one end of the hollow storage compartment 16. In this way, the lid can be pivoted between an open position, to allow the cover 12 to be received in compartment 16, and a closed position, so that the cover 12 is protected against contamination when the toothbrush is in use.

Figure 7:
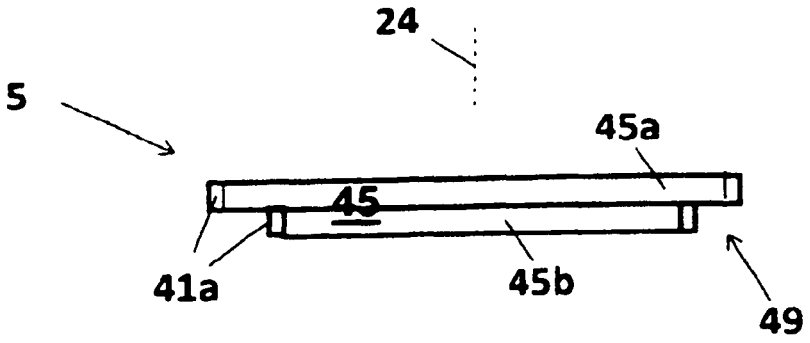
FIG. 7 depicts a cross sectional view along the longitudinal axis of a storage compartment lid, illustrated in FIG. 2.
Figure 8:
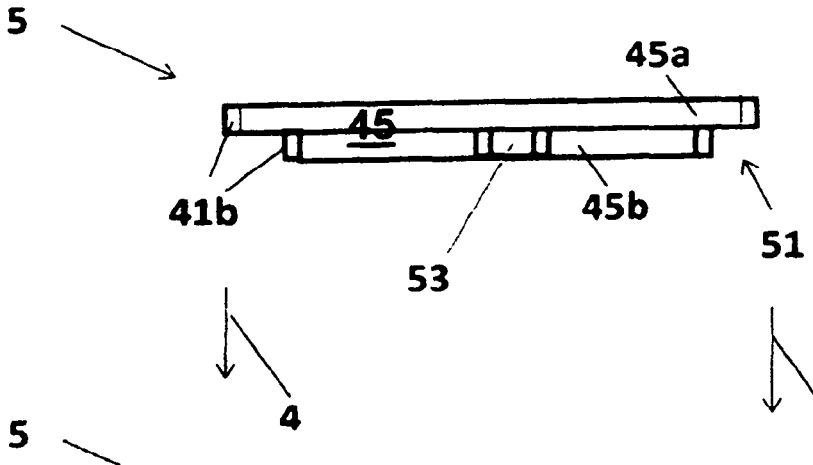
FIG. 8 depicts a cross sectional view along the horizontal axis of a storage compartment lid, illustrated in FIG. 2.

The lid 45 also may have a peripheral mortise 49 and 51, as depicted in FIGS. 7 and 8, that cooperates with the peripheral recess around the compartment 16, so that a substantially airtight seal is formed when the lid 45 is placed over the storage compartment 16. The lid 45 may also have compression points or nibs 41*a*, 41*b* exerting pressure against the recessed rim 39 so that the seal formed when the lid 45 is placed in the recessed rim 39 is essentially complete. The storage compartment 16 is sized to allow insertion of the bifurcated member 15 and the cover 12 so that the lid 45 may close the opening 17.

FIG. 3 depicts a side elevation view of the toothbrush assembly 5 with the cover 12 in a first closed position, in which the open face 12*b* of the cover 12 receives the bristled head BH so that the cover 12 protects the bristles B when not in use.

Figure 4:
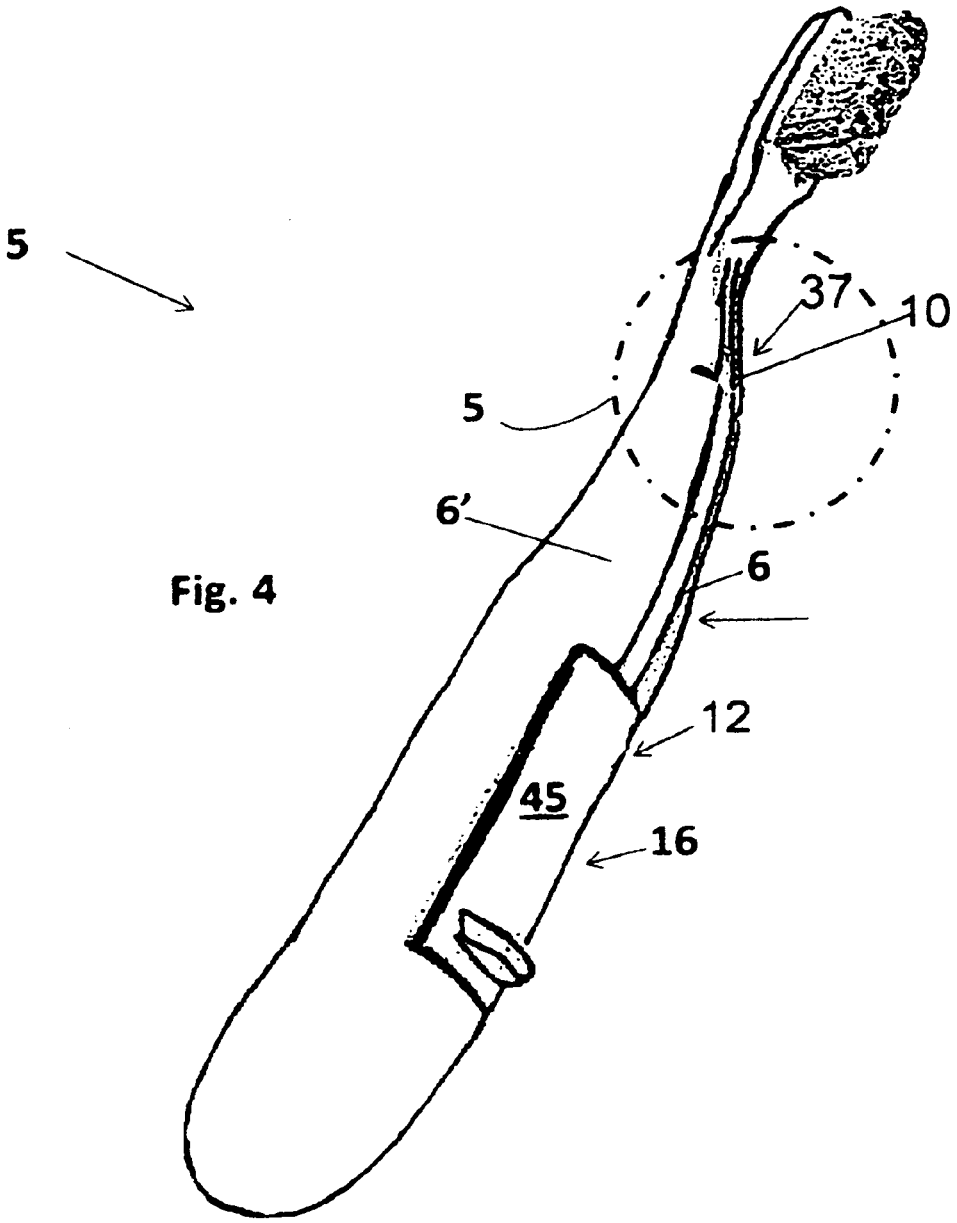
FIG. 4 depicts a side elevation view of a toothbrush assembly having a cover enclosed in a storage compartment covered by a lid.

FIG. 4 depicts a side elevation view of the toothbrush assembly 5 in a second open position, where the bristles are exposed for use and the cover 12 is protected within the hollow storage compartment 16.

In both first and second positions, the spine 14*a* of elongated connector 14 may lie in a groove 18 running along the surface of the body 7 of the toothbrush 5, so that an exposed surface of the spine 14*a* of the elongated connector 14 becomes essentially coplanar with the surface of the body 7 of the toothbrush adjacent to the groove 18.

Figure 10:
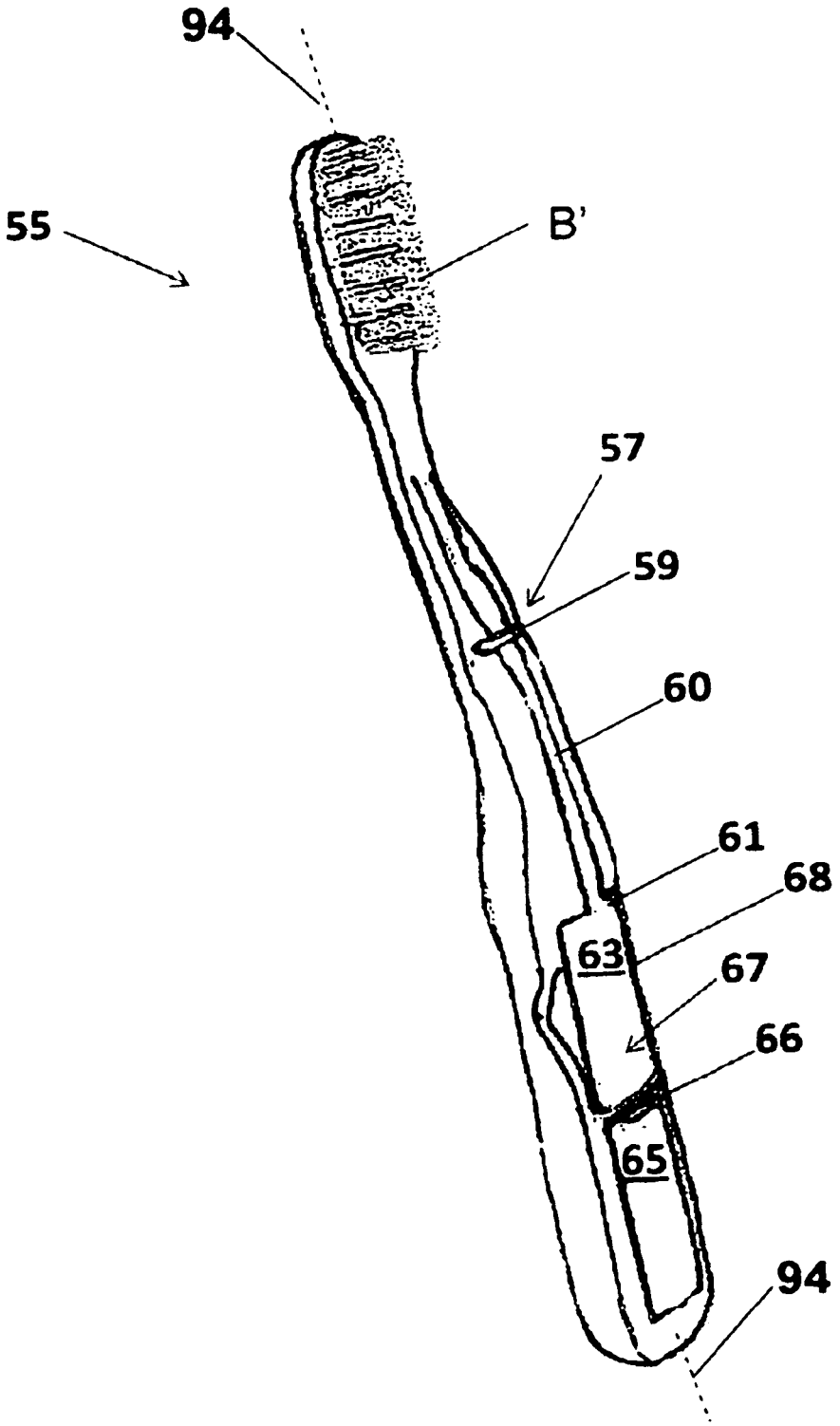
FIG. 10 depicts an elevation view of a toothbrush assembly having a cover in a storage compartment.

FIG. 10 depicts an elevation view of a second embodiment of a toothbrush assembly 55 according to the invention. In this embodiment, the toothbrush assembly again comprises a cover 67 for protecting bristles B' from harmful contaminants, and which is stored in a hollow storage compartment 63 while the brush is in use. As previously, cover 67 may be operably coupled to a single-piece elongated connector 60 having a first end 57 in pivot groove 59 of the toothbrush assembly 55 and a second end 61 operably coupled to the cover 67. In this embodiment, a lid 65 for the storage compartment 63 slides in grooves on opposite sides of the storage compartment rim 68 along the longitudinal axis 94 of the assembly 55. A raised lip 66 on the lid 65 enables a user to more easily apply sliding force to the slidable lid 65 in order to move the slidable lid 65 between open and closed positions.

Figure 11:
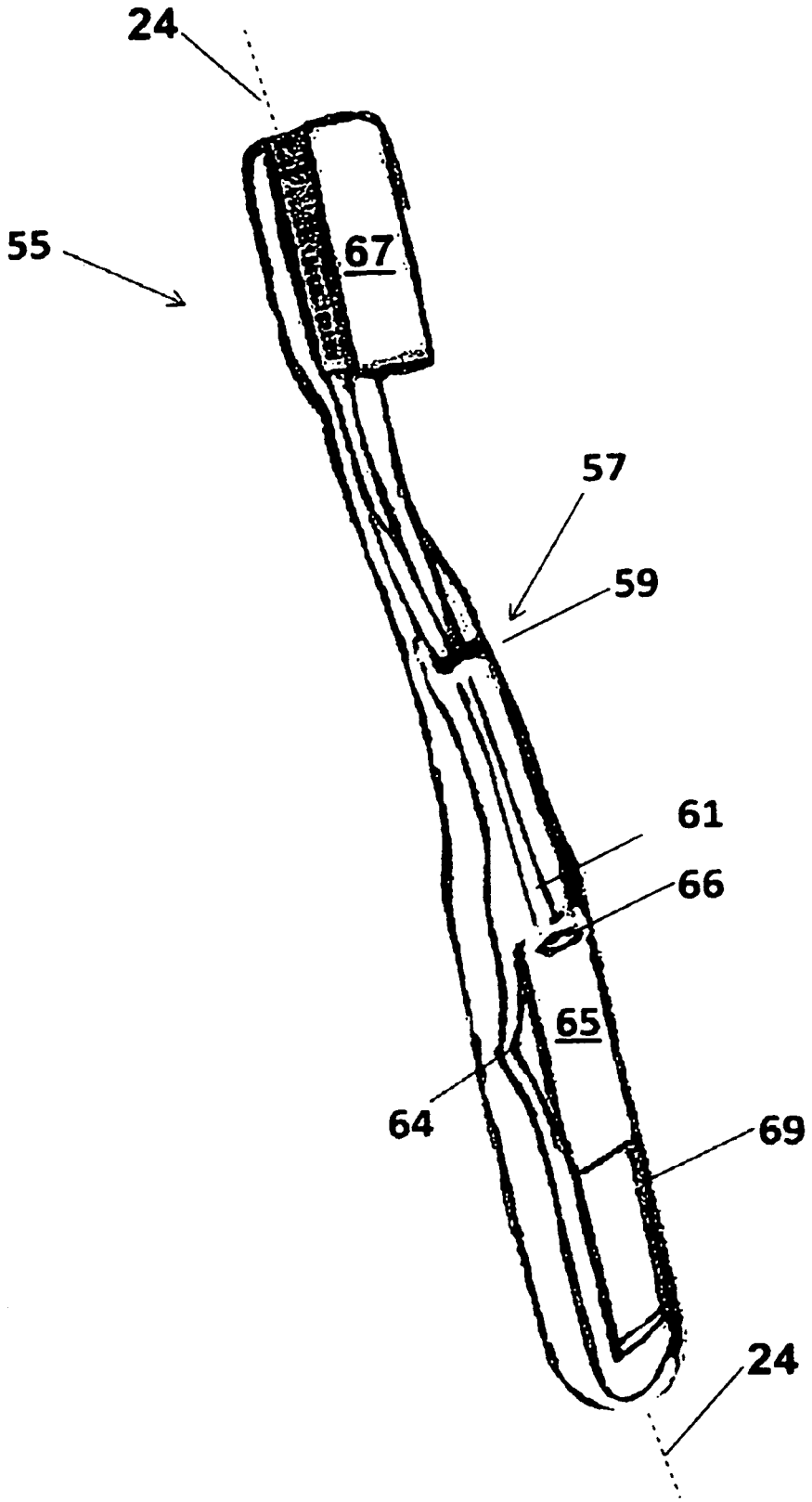
FIG. 11 depicts an elevation view of a toothbrush assembly having a covered brush head and covered storage compartment.

FIG. 11 depicts an elevation view of the toothbrush assembly 55 in a first position having a cover 67 covering bristles B' and slidable lid 65 essentially completely sealing the hollow storage compartment 63.

Figure 12:
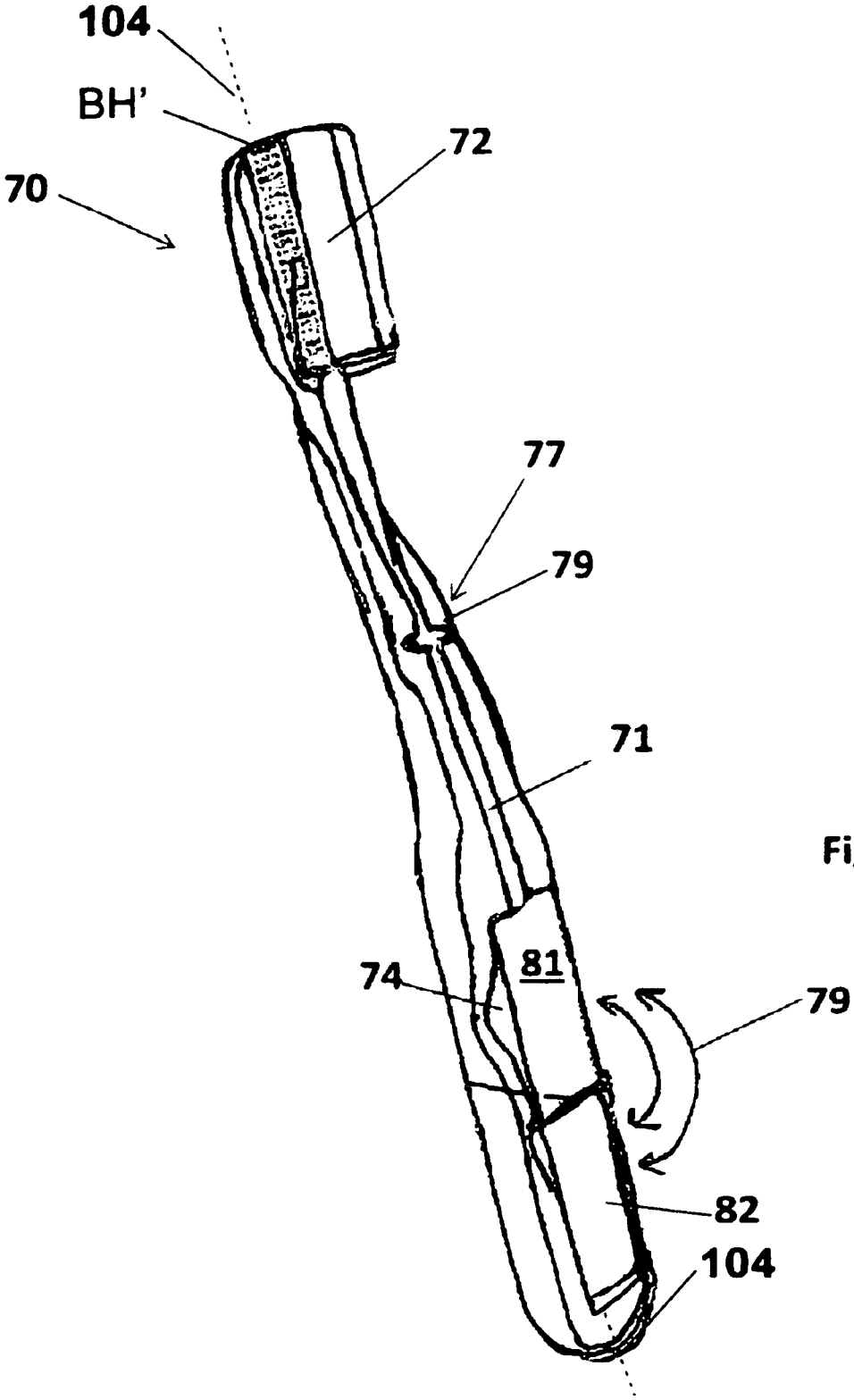
FIG. 12 depicts an elevation view of a toothbrush assembly having a covered brush head and covered storage compartment.

FIG. 12 depicts an elevation view of a further embodiment of a toothbrush assembly 70, shown with a bristle cover 72 covering brush head BH'. In this embodiment, lid 82 is hinged on an axis orthogonal to the longitudinal axis 104 of the assembly 70, that is, transverse to the body of the toothbrush, allowing it to be pivoted between a closed position, in which it covers the cover 72 when in hollow storage compartment 81, and an open position, allowing cover 72 to be disposed in storage compartment 81. A recess 74 is provided to enable a user to exert opening force to open the hinged lid 82.

Figure 13:
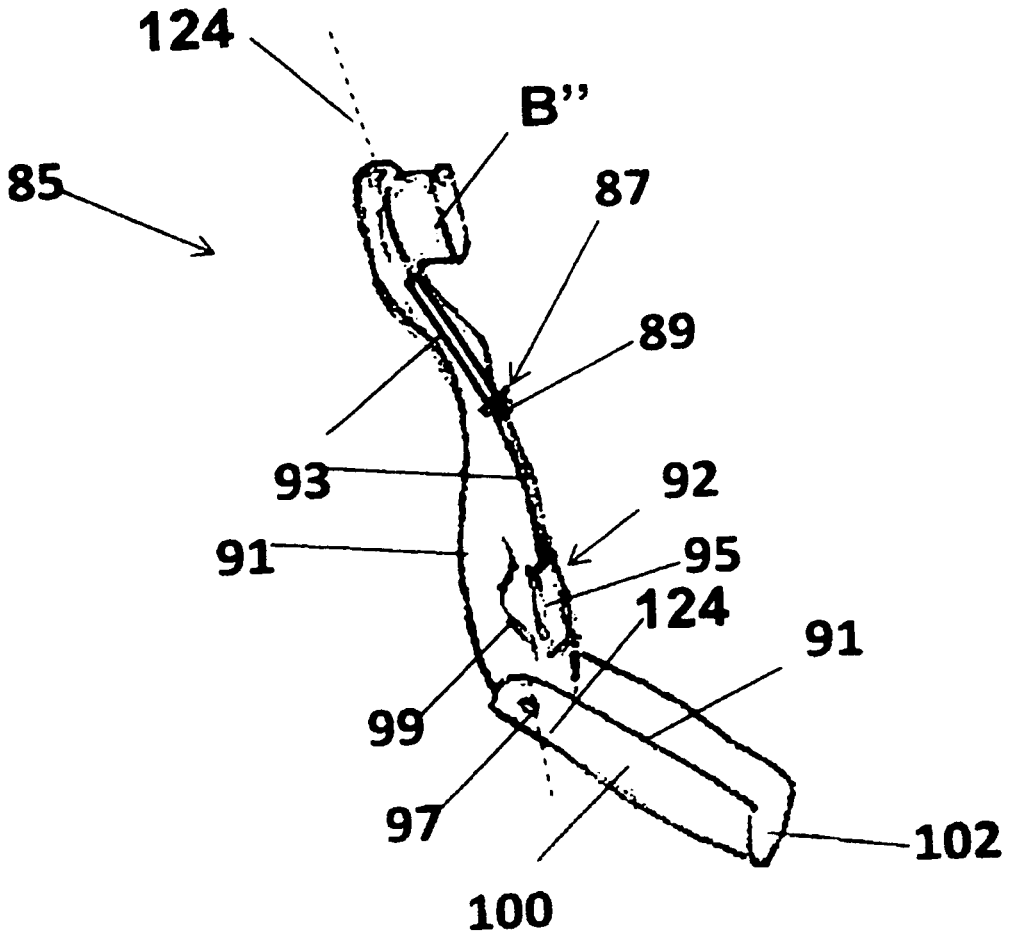
FIG. 13 depicts an elevation view of a toothbrush assembly having a lid operably coupled to a storage compartment.

FIG. 13 depicts an elevation view of a further embodiment of a toothbrush assembly 85 according to the invention. In this embodiment, a hinged lid 100 for closing off a hollow storage compartment 95 is again provided, but in this embodiment, lid 100 is operably coupled to a body 91 of the assembly 85 by hinge 97 disposed near the end of the handle. The hinged lid 100 may cover the storage compartment 95 by rotation of the hinged lid 100 about an axis running transverse to the longitudinal axis 124 of the assembly 85. Lid 97 is essentially U-shaped in cross-section, so as to form an essentially complete seal with the body 91 to protect the cover 92 in the storage compartment 95 from harmful contaminants.

As discussed above, FIG. 14 depicts an expanded elevation view of a cover 12 shown in FIG. 1 for a toothbrush assembly 5 having holes 12*e* on opposed sides for receiving compression points or nibs 20 of the single-piece elongated connector 14 for permitting rotation of the cover. Alternatively, the cover 12 may be intended to be used separately and independently from the single-piece elongated connector 14 to protect the bristles B from harmful contaminants; that is, although in the preferred embodiment the cover is secured to the elongated connector so that it does not become lost, it is also within the scope of the invention to provide a separate cover that is likewise stored in the storage compartment and protected by the lid while the toothbrush is in use.

Figure 9:
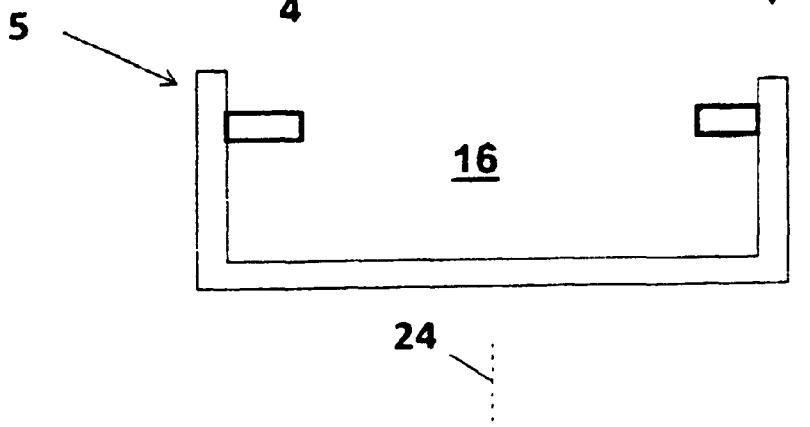
FIG. 9 depicts a side elevation view of a storage compartment having a recessed lip.
Figure 15:
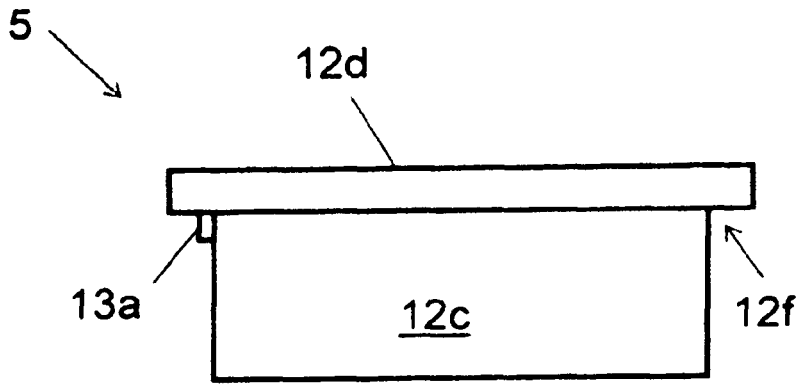
FIG. 15 depicts a cross sectional view along a horizontal axis of a cover of a toothbrush assembly.
Figure 16:
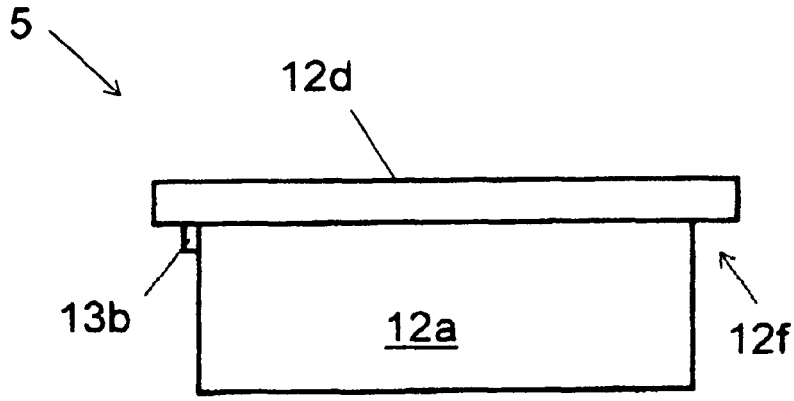
FIG. 16 depicts a cross sectional view along a vertical axis of a cover of a toothbrush assembly.

FIGS. 15 and 16 depict views along horizontal and vertical axes, respectively, of the cover 12 of the toothbrush assembly 5, as depicted in FIG. 14. The cover 12 may have a recessed lip 12*f* and compression points or nibs 13*a, b* so that when the cover 12 is placed in the direction of the arrow 4 (as depicted in FIGS. 7-9 with respect to the compartment lid 45) in the recessed rim 39 of the storage compartment 16, an essentially complete seal is formed because the compression points or nibs 13*a, b* exert pressure against the recessed rim 39.

Figure 17:
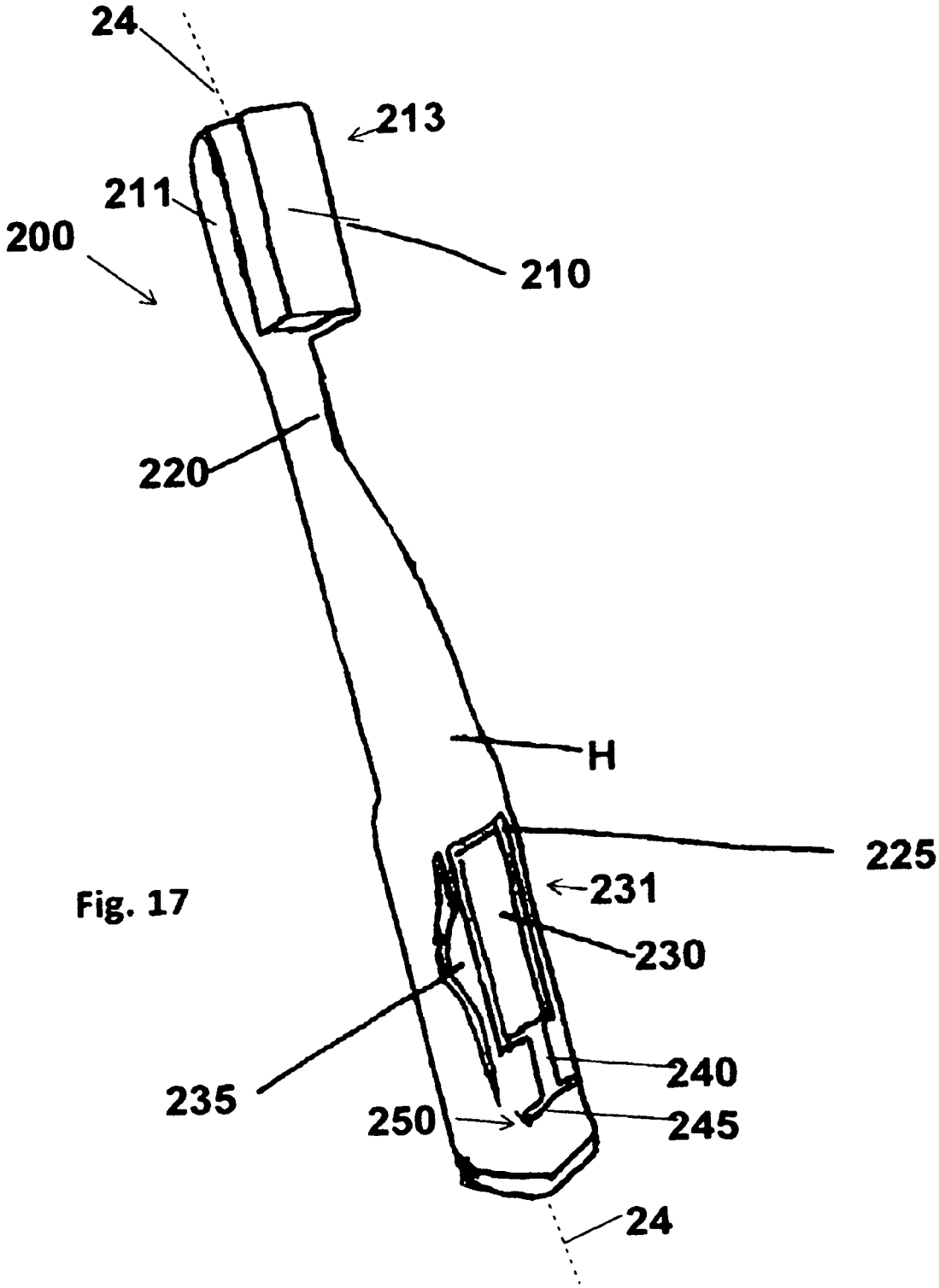
FIG. 17 depicts a side elevation view of a toothbrush assembly having a covered brush head and covered storage compartment.

FIG. 17 depicts a side elevation view of another embodiment of a toothbrush assembly 200 according to the invention. In this embodiment, the toothbrush assembly again comprises a cover 210 covering bristle head 211 but the assembly 200 does not have a single-piece elongated connector operably coupled to the cover 210. A lid 230 covering a hollow storage compartment 231 may be operably coupled to the hollow storage compartment 231. A recess 235 is provided adjacent and below the lid 230 for insertion of a user's finger or alternatively, a lever to pry open the lid 230. The lid 230 is mechanically and physically attached to a lid arm 240, the lid arm 240 ending in a pivot end 245. The pivot end 245 is operably coupled to a groove 250 of the hollow storage compartment 231. Accordingly, the cover 210 is movable between a first position wherein an open face of the cover 210 faces the bristled head 211, so that the cover 210 is disposed over the bristles 213 to protect them when not in use, and a second position wherein the cover 210 is protected within the hollow storage compartment 231 when the brush 200 is in use. As the lid 230 is operably coupled to the hollow storage compartment 231, it is less likely to be lost.

Thus, according to the invention, a method for hygienically cleaning the teeth of a person according to the invention comprises the steps of: providing a toothbrush assembly 5, 55, 70, 85, or 200, wherein the toothbrush assembly 5, 55, 70, 85, or 200 comprises an elongated toothbrush body 7, 91, or 220, having a bristle head BH, BH', or 211 at one end and a handle H at a second end, the handle H comprising a hollow storage compartment 16, 63, 81, 95, or 231, the hollow storage compartment 16, 63, 81, 95, or 231, comprising a lid 45, 65, 82, 100, or 230 wherein the lid 45, 65, 82, 100, or 230 is operably coupled to the hollow storage compartment 16, 63, 81, 95, or 231; covering the bristles B, B', and 213, when the toothbrush assembly 5, 55, 70, 85, or 200 is not in use, with a cover 12 or 210 having an open face enabling the cover 12 or 210 to be placed over the bristles B, B', or 213 to protect them from microbial, viral, or other airborne contaminants, and sealing the cover 12 or 210 in the hollow storage compartment 16, 63, 81, 95, or 231 when the toothbrush assembly 5, 55, 70, 85, or 200 is in use. Preferably, the cover 12 or 210 is cleaned to remove any microbial, viral, or other airborne contaminants before sealing it in the hollow storage compartment 16, 63, 81, 95, or 231.

FIGS. 18-23 show generally a further embodiment of a toothbrush according to the invention, in which the connector to which the bristle cover is secured pivots to the toothbrush about an axis perpendicular to the surface of the toothbrush in which the storage compartment is formed, as compared to the embodiments discussed above, in which the connector pivots about a transverse axis, and wherein the storage compartment is closed by a cover member pivoted to the body of the toothbrush near the end of the handle portion thereof. Several variants on this embodiment are shown by FIGS. 18-23. One advantage of this design is that the open face of the bristle cover will face the bottom of the storage compartment without the necessity of allowing the cover to pivot with respect to the elongated connector, as in other embodiments.

Figure 18:
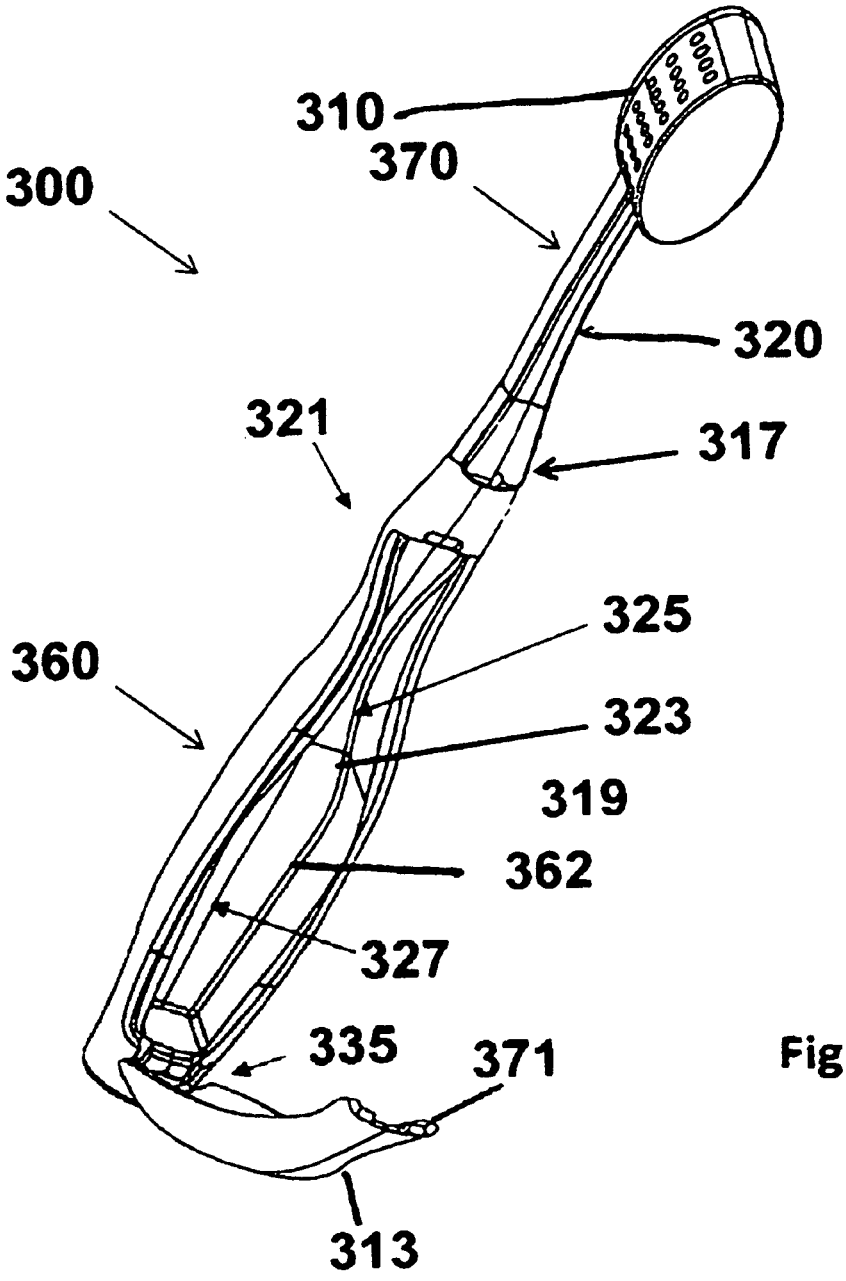
FIG. 18 depicts an elevation view of a toothbrush having an elongated connector and a bristle head cover.
Figure 19:
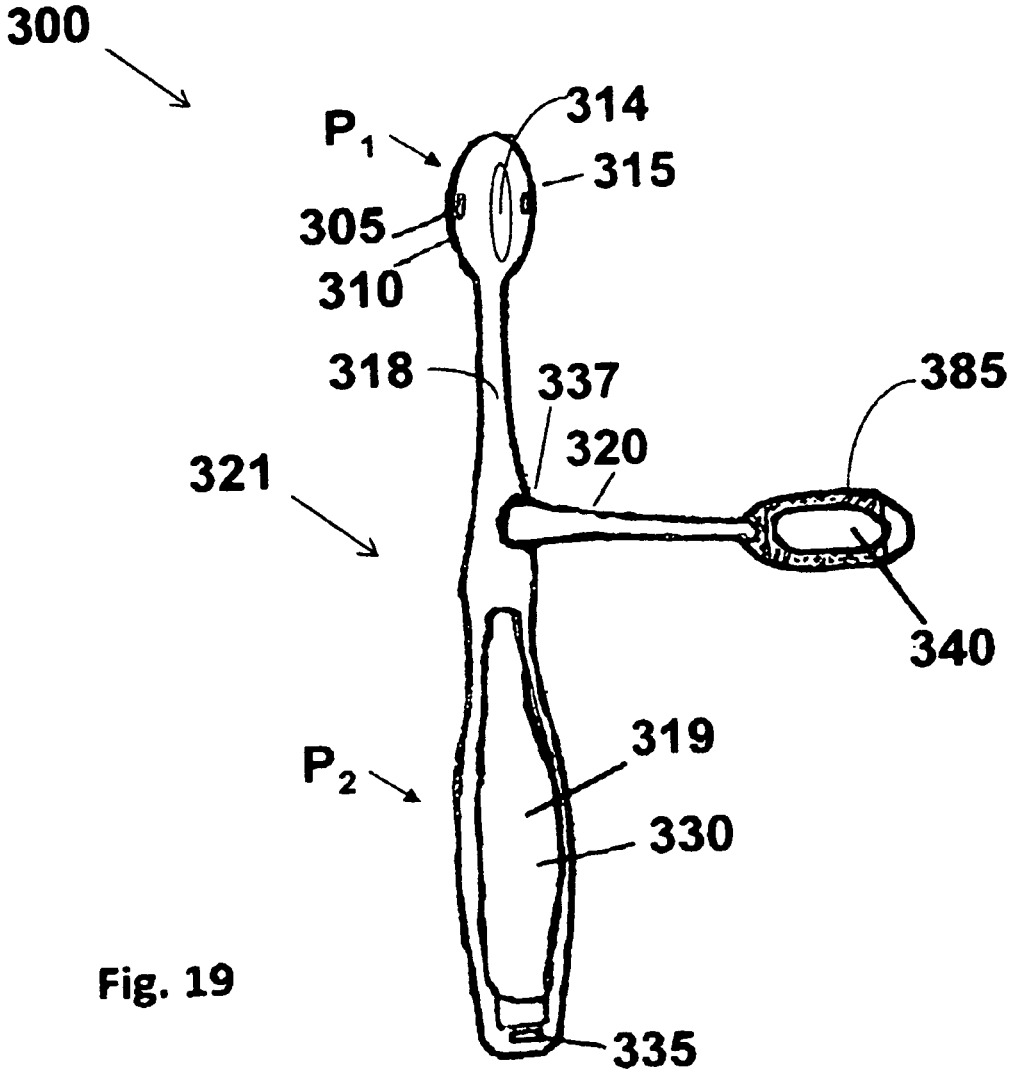
FIG. 19 depicts a longitudinal elevation view of the toothbrush.

FIG. 18 shows an embodiment where the bristle cover would be moved from covering the bristles when not in use to the storage compartment when in use by lifting the brush cover off the bristles and rotating the elongated connector about an axis perpendicular to the surface of the toothbrush extending between the bristle head and handle, so as to place the brush cover in the storage compartment. FIG. 19 shows the same embodiment but illustrates the elongated connector/bristle cover in a "mid-way" position to make the movement more clear. This may be implemented by provision of a simple pivot mechanism allowing the elongated connector with bristle protector to pivot 180 degrees (in either direction, clockwise or counterclockwise) about an axis perpendicular to the toothbrush body, so as to move the cover into the storage compartment. For example, the pivot mechanism can be implemented by providing a pin configured as a split pin with an enlarged head on the end of the elongated connector, which is snap-fit into a corresponding bore in the body of the toothbrush. The pivot joint can be made sufficiently loose to allow the bristle cover to be lifted off the bristles, or the elongated connector can be flexed to allow this movement. The joint is designed so that the elongated connector and bristle cover are retained by the body of the toothbrush, encouraging their use.

Figure 20:
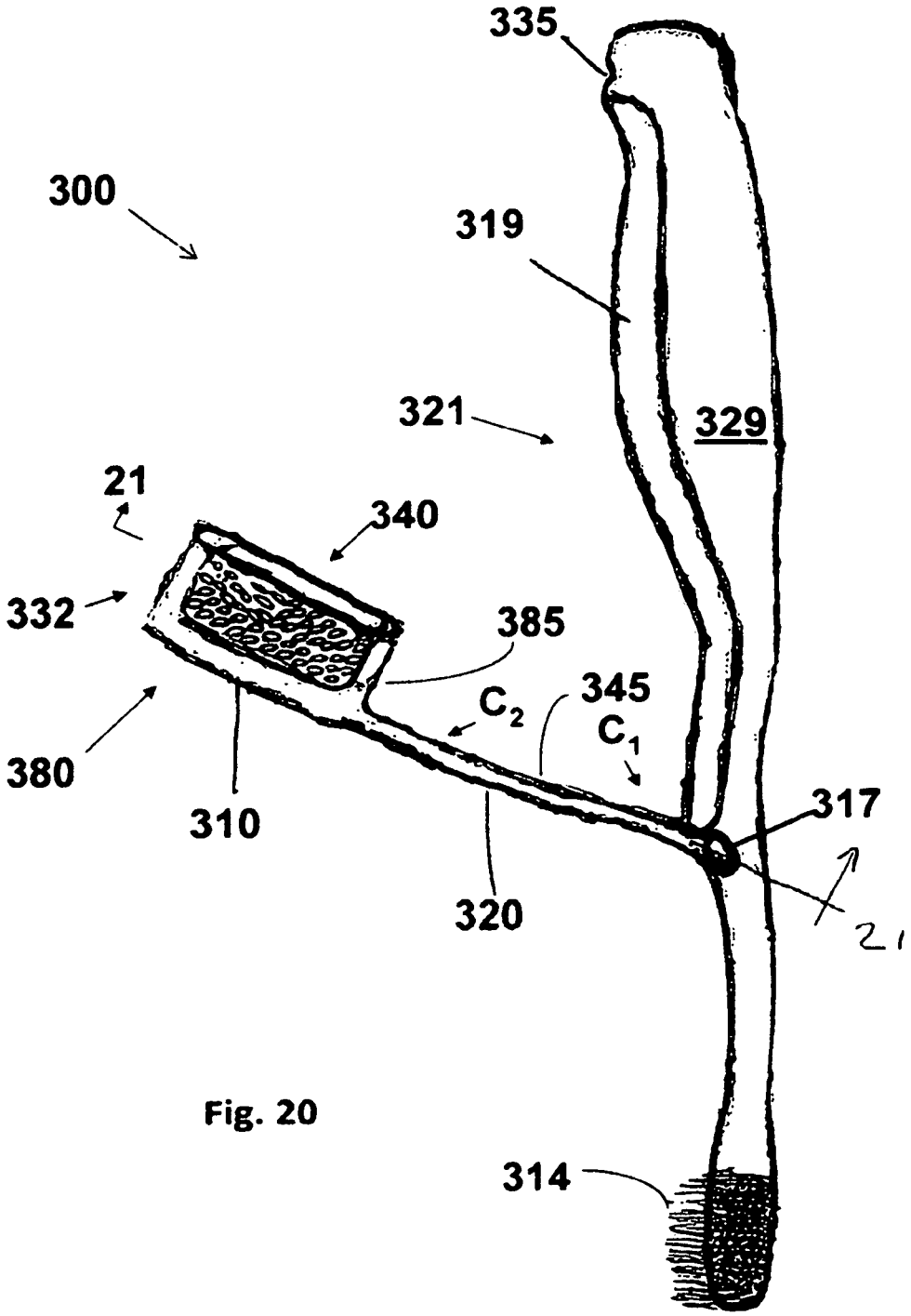
FIG. 20 depicts a side elevation view of the toothbrush.

FIG. 20 shows a somewhat different embodiment, in which the pivot connection between the body of the toothbrush and the elongated connector comprises a ball and socket joint, with a ball on one of the connector and body and a socket on the other. The joint is designed so that elongated connector with bristle protector can rotate 360 degrees about an axis generally perpendicular to the surface of the body of the toothbrush, and to some degree out of the plane including the surface of the toothbrush, and so that the elongated connector and brush cover are retained, encouraging their use.

Thus, FIG. 18 depicts a perspective view of a toothbrush 300 having a movable elongated connector 320 to which a bristle cover 310 is secured, and a bristle head 310 and bristles 314 that run orthogonally to the plane of the bristle head 310, a storage compartment 319 and a hinged lid 313. The toothbrush 300 includes a joint 317 allowing the elongated connector to be moved with respect to the body. The joint may comprise an expandable opening in one of the elongated connector and body formed by the ends of deformable finger members, so as to be deformed to receive a spherical member in the other and thereafter retain it. Alternatively, the joint may comprise a bore in one or other of the elongated connector and body for receiving a pin having a head in the form of a split ball, so that the ball is compressed upon insertion into the corresponding bore and thereafter retained, allowing the elongated connector 320 to pivot.

In another aspect of the invention, FIG. 18 depicts a recess 362 running along a perimeter of the cavity 330 of the storage compartment 319. As illustrated in FIG. 18, compression members 371 are disposed around a periphery of the replacable lid 313 which may be snapped into the recess 362 to secure the lid in the closed position As shown in FIG. 19, the elongated connector 320 is movable between a first position $P_1$, in which the protective bristle head cover 332 covers the toothbrush bristles 314, and a second position $P_2$ in which the protective bristle head cover 332 is stored in a cavity 330 of the storage compartment 319. Nub(s) 305, 315, or any appropriate compression fitting, extend in a perpendicular direction from the first surface 318 of the elongated toothbrush body 321 so as to grip the cover and secure it in position over the bristles. The replaceable lid 313, depicted in FIG. 18, may be operably coupled to the first surface 318 by hinge 335, as discussed above in connection with other embodiments, or by another appropriate joining device.

In the embodiment of FIGS. 18-20, the toothbrush 300 comprises an elongated toothbrush body 321, having first and second ends 360, 370 and a first surface 318 thereon. The elongated toothbrush body 321 comprises a bristle head 310 operably coupled to the first surface 318 of the elongated toothbrush body 321 at the first end 370 of the elongated toothbrush body 321. The elongated toothbrush body 321 has an opening 330 in the first surface 318 of the elongated toothbrush body 321 at the second end 360 of the elongated toothbrush body 321. The opening 330 is an entrance of a storage compartment in the second end 360 of the elongated toothbrush body 321. The storage compartment 319 is defined by lateral walls 323 and a bottom 325 of the storage compartment 319. The bottom 325 of the storage compartment 319 has a second surface 327 thereon.

Figure 23:
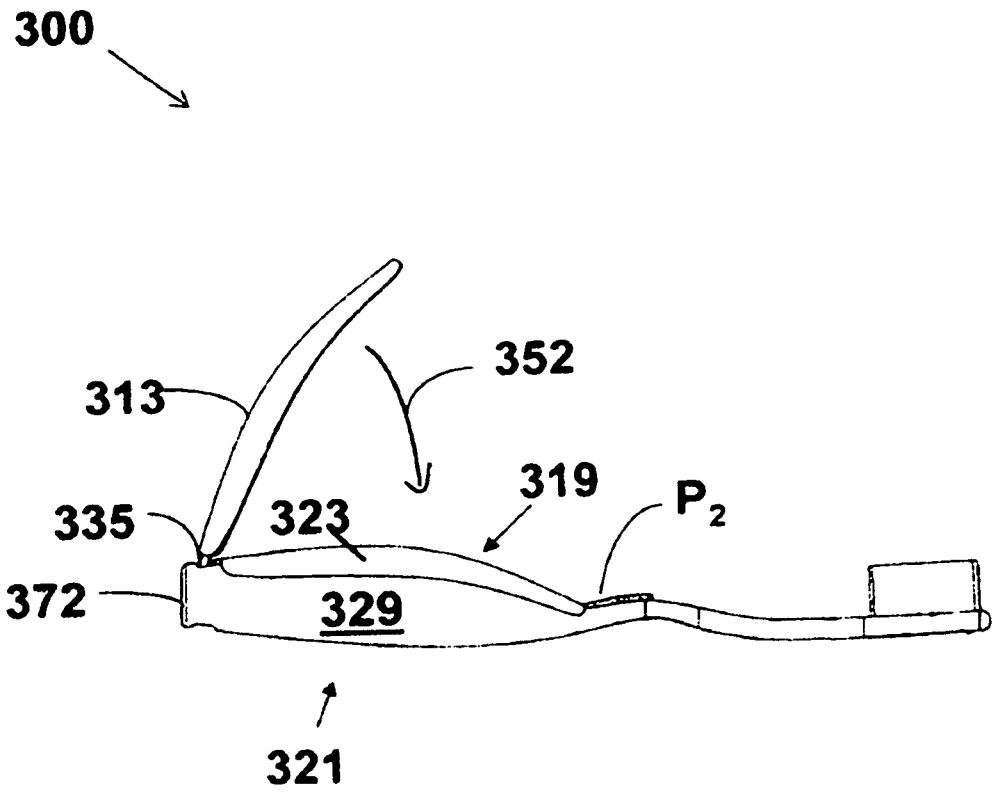
FIG. 23 depicts a side elevation view of the toothbrush.

Further, in the specific variant of this embodiment shown in FIGS. 18 and 23, the storage compartment is not simply sized to receive the bristle cover, as in the embodiments above, but is essentially the entire interior of the handle of the toothbrush; that is, in this embodiment the handle is essentially hollow. Likewise, instead of the lid of the storage compartment simply being sized to close a storage compartment sized to receive the bristle head, the lid is instead contoured to complete the entire outer surface of the handle of the toothbrush. Preferably, the lid fits essentially flush with the main portion of the handle of the toothbrush, for esthetics and to provide an effective seal against contaminants.

FIG. 20 depicts a side elevation view of the toothbrush 300, and shows an embodiment in which the elongated toothbrush body 321 comprises a protective bristle cover 332 having an open face 340 enabling the protective bristle cover 332 to be placed over the bristles 314. The elongated connector 320 may have a first end $C_1$ pivoted to the elongated toothbrush body 321 between the bristled head 314 and the opening 330, and a second end $C_2$ operably coupled to the protective bristle cover 332, so that the protective bristle cover 332 is movable between a first position $P_1$ and a second position $P_2$. In the first position $P_1$, the open face 325 of the protective bristle cover 332 faces the bristled head 310 so that the cover 332 encloses the bristles to protect them when not in use. In the second position $P_2$, the open face 340 of the protective bristle cover 332 faces the second surface 327 of the bottom 325 of the storage compartment 319.

In a further variant also shown in FIG. 20, sides 380 of the protective bristle cover 332 that are parallel to the bristles 314 of the bristle head 310 are porous and a proximal end of the protective bristle head cover 332 includes an opening indicated generally at 385, for better drainage.

Figure 21:
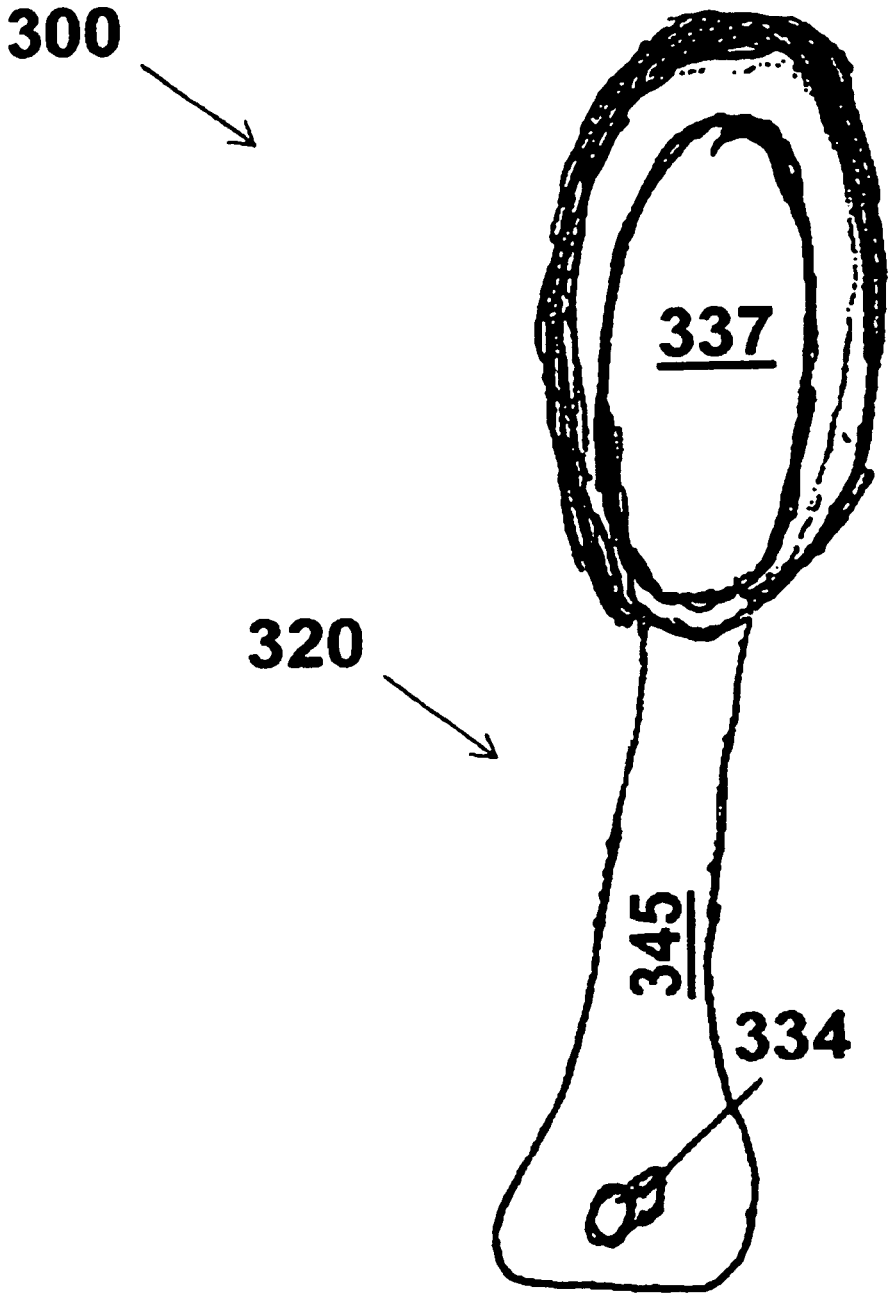
FIG. 21 depicts a plan view of the elongated connector of the toothbrush taken along the line 21-21 in FIG. 20.

FIG. 21 depicts a plan view of the elongated connector 320 and bristle cover 340 of the toothbrush 300 taken generally along the line 21-21 in FIG. 20. In this embodiment, the elongated connector 320 comprises a male nub 334 to be received in a bore in the body of the toothbrush, between the first end 370 and the second end 360. The male nub may be split longitudinally, so as to be compressed upon insertion into the bore and retained therein. Alternatively, the elongated toothbrush body 321 can be formed to define an expandable opening 337, so that the male nub 334 can be received in and retained by the opening 337. Alternatively, the nub could be formed on the body of the toothbrush and received in a bore in the elongated connector. This same type of connection can be used further up the brush neck approaching the head to secure the toothbrush cover over the bristles.

Figure 22:
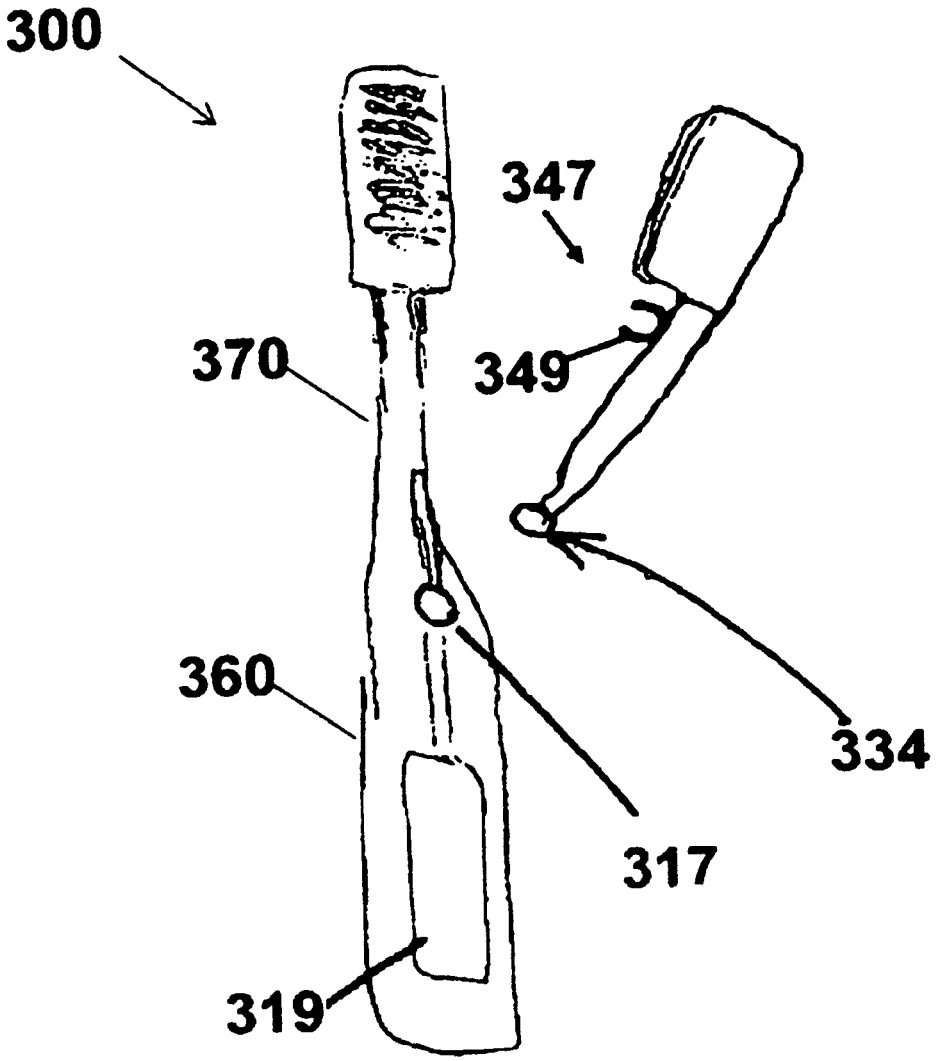
FIG. 22 depicts an elevation view of the toothbrush.

FIG. 22 depicts an elevation view of the toothbrush 300, illustrating further possible variations still within the scope of the invention. In this variant, the elongated connector 320 comprises a resilient C-shaped clip 349 for securing the elongated connector 320 to the elongated toothbrush body 321, so that the protective bristle cover 332 encloses the bristles 314 of the bristled head 310. Other means for securing the cover over the bristle head are within the scope of the invention, such as a deformable nub received in a bore in the toothbrush, or cooperating tabs in the cover and recesses in the bristle head. One advantage of the C-clip design shown is that they space the cover from the bottom of storage compartment, allowing drainage and drying to occur.

In a further variant, also shown in FIG. 22, the pivotable coupling 317 at the first end $C_1$ of the elongated connector 320 includes a spherically shaped member 334 that compressibly fits into an expandable opening 317 in the elongated toothbrush body 321, so that the first end $C_1$ of the elongated connector 320 is pivotable between the first $P_1$ and second $P_2$ positions. As previously, only sides 380, as depicted in FIG. 20, of the protective bristle cover 332 that are parallel to the bristles 314 of the bristle head 310 are porous.

FIG. 23 depicts a side elevation view of the toothbrush 300. As shown, a replaceable lid 313 is pivotably coupled to the first surface 318 of the elongated toothbrush body 321 so as to fit essentially flush with the first surface 318 when the lid 313 is closed, covering the cavity 330 of the storage compartment 319, so that the inside environment of the storage compartment 319 is effectively sealed. FIG. 23 illustrates that the replaceable lid 313 may open or close in the direction of the arrow 352 when the elongated connector and protective bristle cover 332 are in the storage compartment 319. The lid 313 could likewise be pivotably attached to either side of the toothbrush body. An opening indicated generally at 372 to the outside environment may also be provided, to allow ventilation of the compartment or for better drainage and drying out of the storage compartment.

In each embodiment, the protective bristle cover 332 and the elongated connector 320, or the entire toothbrush 300 are preferably treated with an antibacterial solution. The antibacterial solution may be an aqueous solution of from about 0.01 to about 30 percent by weight hydrogen peroxide in water or isopropanol. Alternatively, it may be a commercial mouthwash/disinfectant, silver-containing composite chemical or any other suitable antimicrobial.

FIG. 19 depicts an embodiment of the invention, in which a portion of the first surface 318 of the elongated toothbrush body 321 that faces the opening 340 of the protective bristle cover 332 is formed to comprise at least one nub(s) 305, 315 that run in the orthogonal direction with respect to the first surface 318, while an edge 385 of the protective bristle cover 332 that faces the first surface 318 of the elongated toothbrush body 321 is resiliently deformable, so that the expandable edge forms a releasable compression snap-fit over the at least one nub(s) 305, 315 when the protective bristle cover 332 is in the first position $P_1$.

The invention also includes a method of protecting the bristles 314 of a toothbrush 300 in which an elongated toothbrush body 321, having first and second ends 370, 360, and a first surface 314, thereon is first provided. The toothbrush 300 comprises a bristle head 310 operably coupled to the first surface 318 of the elongated toothbrush body 321 at the first end 370 of the elongated toothbrush body 321. The toothbrush 300 comprises an opening 337 in the first surface 318 of the elongated toothbrush body 320 at the second end 360 of the elongated toothbrush body 321. The opening 317 is an entrance of a storage compartment 319 in the second end of the elongated toothbrush body 321. A volume of the cavity 330 of the storage compartment 319 is defined by lateral walls 323 and a bottom 325. The bottom 325 of the storage compartment 319 has a second surface 327 thereon. The toothbrush also comprises a protective bristle cover 332 having an open face 340 enabling the protective bristle cover 332 to be placed over the bristles 314. An elongated connector 320 is also provided, having a first end $C_1$ pivoted to the toothbrush body 321 between the bristled head 310 and the opening 317, and a second end $C_2$ operably coupled to the protective bristle cover 332, so that the protective bristle cover 332 is movable between a first position $P_1$ and a second position $P_2$. In the first position $P_1$, the open face 340 of the protective bristle cover 332 faces the bristled head 310 and encloses the bristles 314 to protect them when not in use. The open face 340 of the protective bristle cover 332 faces the second surface 327 of the bottom 325 of the storage compartment 319 in the second position $P_2$.

Thus, in practice of the method of the invention, the first end C1 of the elongated connector 320 is pivoted radially to move the protective bristle cover 332 from the first position $P_1$ to the second position $P_2$. A user of the toothbrush may lift the protective bristle cover away from the bristle head of the elongated toothbrush body by flexing the second end of the elongated connector and pivoting the second end of the elongated connector to the second position. The method may also comprise a step of treating only the protective bristle cover and the elongated connector or the entire toothbrush 300 with an antibacterial/antimicrobial solution. The antibacterial/antimicrobial solution may be an aqueous solution of from about 0.01 to about 30 percent by weight hydrogen peroxide in water or isopropanol or a silver-containing antibacterial/antimicrobial solution.

In an embodiment of the method of the invention, the first end of the elongated connector pivots radially between about 0° and 360° when the protective bristle cover is moved from the first position to the second position and returned to the first position. Depending on the constructional details of the toothbrush, the elongated connector is pivoted about an axis transverse to the direction of elongation of the toothbrush body, or about an axis that is generally perpendicular thereto.

In a further aspect of the method of the invention, in an embodiment of the toothbrush wherein the elongated connector is pivoted about an axis transverse to the body of the toothbrush, the bristle cover is pivoted about the end of the elongated connector, so that the open face of the cover faces the bottom of the storage compartment.

Figure 24:
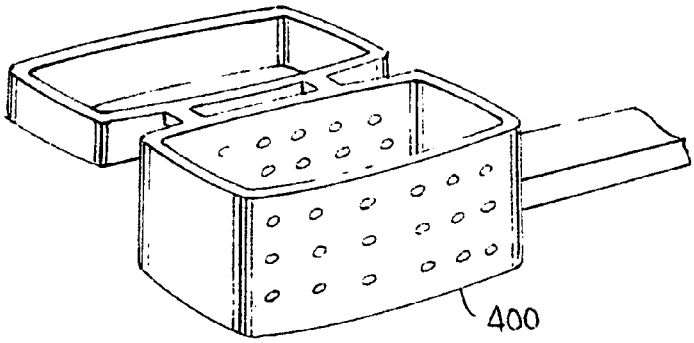
FIG. 24 depicts a further option, a lid attached to the cover of the toothbrush.
Figure 26:
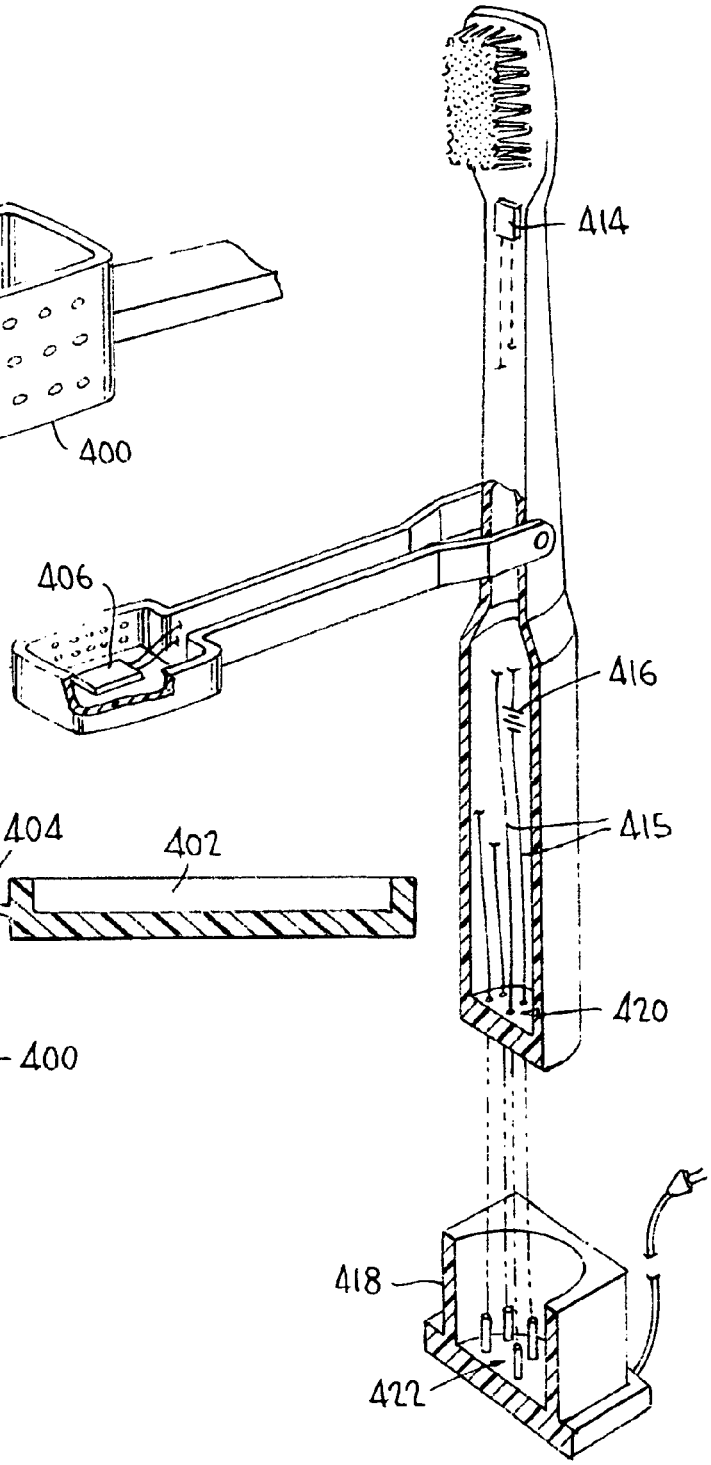
FIG. 26 shows an assembly of a toothbrush comprising an ultrasonic vibratory device and an ultraviolet radiation source with a base unit providing battery charging current for batteries powering the ultrasonic vibratory device and power to the ultraviolet radiation source.
Figure 25:
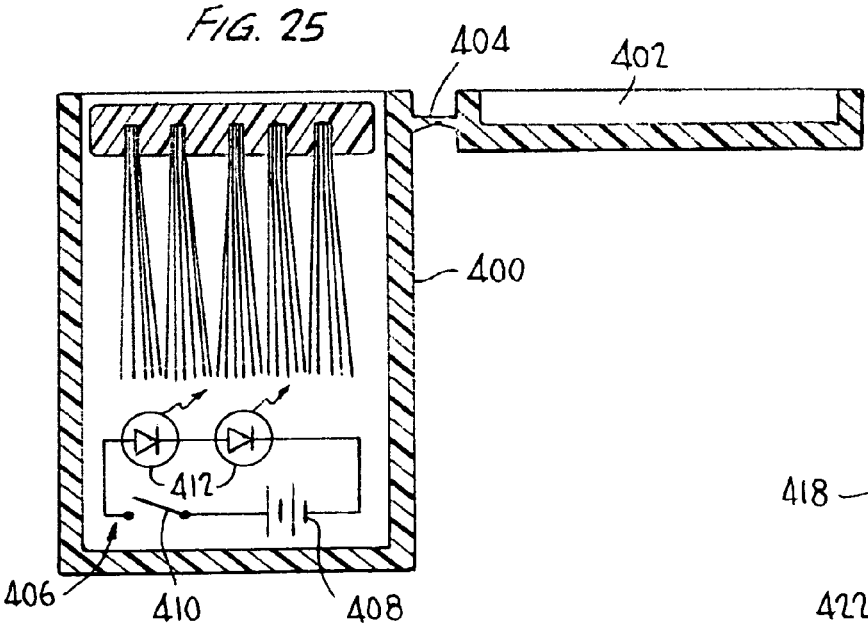
FIG. 25, being a cross-section through the bristle head of the toothbrush with the cover in place, depicts a further option, that is, incorporation of a sterilizing ultraviolet radiation source into the cover of the toothbrush.

FIGS. 24-26 show further variants within the scope of the invention. FIGS. 24 and 25 relate to further improvements in the bristle cover, and FIG. 26 to an integrated system for powering several additional components.

Thus, in FIGS. 24 and 25, the bristle cover 402 is provided with lid 402 that may be integrally molded therewith, along with living hinges 404—that is, members of reduced cross-sectional area, so as to define hinging points. As shown by FIG. 25, the lid 402 can be snapped over the cover 400, enclosing the bristles for further protection. Also shown schematically in FIG. 25 is a source 406 of sterilizing ultraviolet (UV) radiation, comprising a power supply 408, a switch 410, and UV emitting lamp(s) 412. As is well-known, providing a source of UV in close proximity to the bristles will be effective in destroying bacteria and the like.

FIG. 26 shows an integrated system for use of the toothbrush of the invention, comprising a UV source 406 as discussed immediately above and an ultrasonic vibrator 414, as mentioned above in connection with FIG. 1. These electrical devices will require power, the ultrasonic vibrator when the brush is in use and the UV source when the cover is replaced over the bristles after brushing. In order to avoid the use of power cords, preferably the ultrasonic vibrator 414 is powered by batteries 416 in the body of the toothbrush, connected thereto by conductors 415. When the toothbrush is replaced in a base station 418, contacts 420 in the toothbrush and 422 in the base station 418 mate, completing a circuit comprising well-known battery charging circuitry in the base station 418 for charging batteries 416. Additional contacts supply power to the UV source 406, typically for a short period of time after each replacement of the toothbrush in the base station 418.

The elongated connector and other parts of the toothbrush of the invention are preferably molded of a somewhat flexible plastic material, such as low or high density polyethylene (PE), low or high density polypropylene (PP), or polyvinylchloride (PVC).

Figure 27:
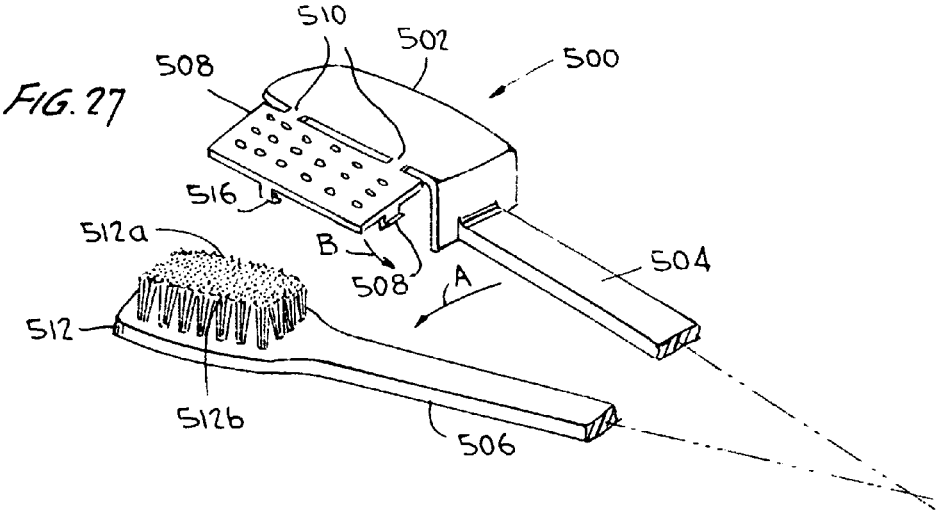
FIGS. 27 and 28 disclose alternative embodiments of the bristle cover.
Figure 28:
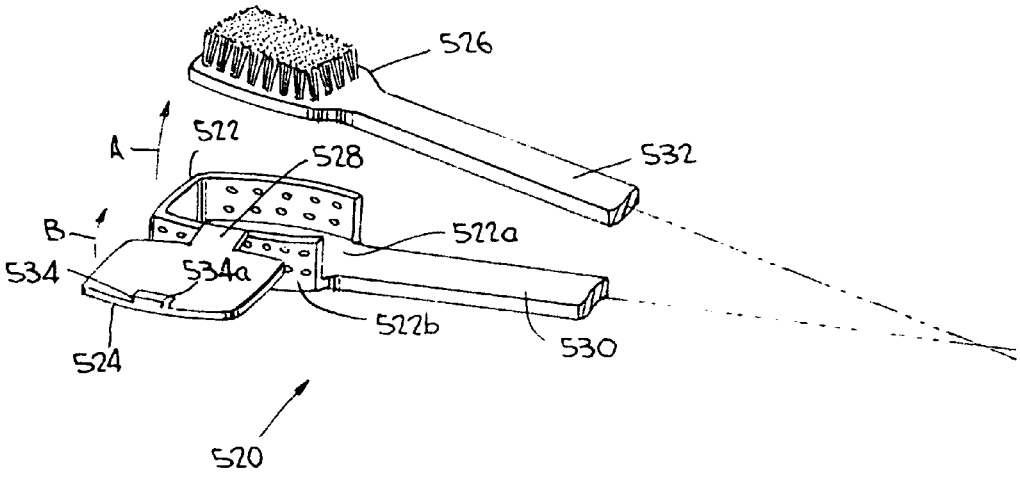

FIGS. 27 and 28 address a possible problem with the designs for the brush covers discussed in the preceding, namely, that if the brush cover is designed to be placed directly over the bristles by motion in a direction opposite to the elongation of the bristles (see, e.g., FIG. 1) the edges of the open side of the brush cover tend to catch on the bristles, fraying them. The embodiments of FIGS. 27 and 28 avoid this problem by providing brush covers that are closed over the bristle head in ways that avoid the user's having to urge the brush cover directly down over the bristle head.

Thus, in FIG. 27, the bristle cover 500 is formed by molding to comprise a clam-shell style cover, having a first portion 502 that is fixed to the elongated connector 504 (which is pivotably affixed to the brush body 506 as in the embodiments discussed above) and a second portion 508. Second portion 508 is hinged to the first portion 502 by a "living hinge" 510, that is, by a hinge formed integrally with the first and section portions 502 and 508 respectively, but of reduced cross-sectional area, so as to define a hinging line.

In use, to close the cover over the bristle head, the cover 500 is pivoted with respect to the bristle head 512 in the direction indicated by arrow A until the first portion 502 abuts the corresponding peripheral edge 512*a* of the bristle head 512. The second portion 508 is then pivoted downwardly about hinge 510 in the direction indicated by arrow B until it abuts the corresponding peripheral edge 512*b*. In this way the bristle head is covered properly without the necessity of urging the cover downwardly over the bristles, and avoiding fraying of the bristles.

The cover 500 may be retained on the bristle head 512 by a hook 516 depending from the first portion 508 (or from the second portion 502) and sized to fit over the back of the bristle head 512. The second portion 508 can be secured in the closed position by a catch 508*a* that is received in a recess (not shown) in the inner wall of the first portion 502; a similar combination of catch and recess can be provided on both ends of the joint between the first and second portions 502 and 508 of the cover 500.

FIG. 28 shows another embodiment of the bristle cover 520. In this embodiment, as can be seen, the bristle cover 520 comprises a box portion 522 comprising a back wall 522*a*, configured to conform to the shape of the bristle head 526, and a side wall 522*b*, shaped similarly and extending perpendicularly from the back wall 522*a* to a height sufficient to receive the bristle head therein. The cover 520 also comprises a lid 524, attached to the side wall 522*b* by a hinge 528. The bristle cover 520 comprises an elongated connector 530, formed integrally with the cover 520, which is, pivoted to the brush handle 532 by a connection allowing relative motion, as discussed above.

In use, therefore, to enclose the bristle head 526 in the cover 520, the cover 520 is pivoted with respect to the handle 532 so as to be disposed behind the bristle head 526, and then brought upwardly, in the direction indicated by arrow A, so that the bristle head 526 is received in the box portion 522. Lid 524 is then pivoted in the direction indicated by arrow B so as to close the box, enclosing the bristle head 526. Lid 524 can be retained in the closed position by a tab 534, comprising a barb 534*a* received in a recess (not shown) in the opposed side wall 522*b* of the box portion 522. Again, in this way the bristle head is covered properly without the necessity of urging the cover downwardly over the bristles, and avoiding fraying of the bristles.

It will be appreciated that in this embodiment, the elongated connector 530 is pivoted to the rear side of the brush handle 532, and that the recess in the brush handle in which the cover is disposed while the brush is in use, and the cover of that recess, will likewise need to be provided in the rear side of the brush handle. The modifications to the brush designs discussed in detail above that would be required to accommodate the cover design of FIG. 28 will be apparent to those of skill in the art, and need not be detailed herein.

The invention in its broader aspects is not limited to a singular preferred embodiment shown herein but may be practiced in different embodiments including differing materials, components, and arrangement and manipulations thereof. The invention in such broader aspects is limited only by the claims hereinafter made.

I claim:

1. A toothbrush assembly, comprising:

an elongated toothbrush body having a bristle head at one end and a handle at a second end, the handle comprising a storage compartment, the storage compartment comprising a lid, wherein the lid is operably coupled to the storage compartment so as to allow the storage compartment to be opened and closed as desired;

a cover comprising an open side enabling the cover to be placed over the bristle head;

an elongated connector comprising a first end pivotably coupled to the toothbrush body between the bristle head and the storage compartment and a second end operably coupled to the cover, whereby the cover is movable between a first position wherein the open side of the cover faces the bristle head and the cover is disposed over the bristles to protect them when not in use and a second position wherein the cover is protected within the storage compartment by closing of the lid when the brush is in use; and means for selectively retaining the cover in the first or second position.

2. The toothbrush assembly of claim 1, wherein the elongated connector is pivotably coupled to the toothbrush body such that the elongated connector pivots about an axis transverse to the direction of elongation of the toothbrush body.

3. The toothbrush assembly of claim 2, wherein the first end of the elongated connector is formed to define a transverse member fitting into and retained by a corresponding transverse groove in the toothbrush body.

4. The toothbrush assembly of claim 2, wherein the second end of the elongated member is bifurcated, defining opposed arms between which the cover is retained by means permitting the cover to be pivoted with respect to the elongated member, whereby the open side of the cover can face the interior of the storage compartment when in the second position.

5. The toothbrush assembly of claim 4, wherein said means permitting the cover to be pivoted with respect to the elongated member comprises opposed nubs on the opposed arms fitting into corresponding bores in the cover.

6. The toothbrush assembly of claim 1, wherein the elongated connector is pivoted to the body of the toothbrush about an axis generally perpendicular to a surface of the toothbrush body extending between the bristle head and handle.

7. The toothbrush assembly of claim 6, wherein the elongated connector is pivoted to the body of the toothbrush by a joint comprising a pin having a head of larger diameter formed on one of the elongated connector and body of the toothbrush retained in a bore formed in the other of the elongated connector and body of the toothbrush.

8. The toothbrush assembly of claim 7, wherein said pin is split to allow it to be inserted into said bore.

9. The toothbrush assembly of claim 1, wherein said lid of said storage compartment is hinged to the body of said toothbrush at one side or end of the storage compartment for movement between open and closed positions.

10. The toothbrush assembly of claim 9, wherein said storage compartment is sized to receive the bristle head, and said lid is of corresponding dimension.

11. The toothbrush assembly of claim 9, wherein the handle of said toothbrush is essentially hollow, such that interior of said handle forms said storage compartment, and wherein said lid essentially completes a surface of the handle of the toothbrush.

12. The toothbrush assembly of claim 11, wherein said lid is hinged to the body of said toothbrush at the end of the handle opposite the bristle head.

13. The toothbrush assembly of claim 1, wherein said lid of said storage compartment slides between open and closed positions in channels formed in the body of said toothbrush and extending along an open side of said storage compartment.

14. The toothbrush assembly of claim 1, further comprising a second lid for closing the open side of the cover.

15. The toothbrush assembly of claim 14, wherein said lid for closing the open side of the cover is attached to one side or end of the cover by a living hinge.

16. The toothbrush assembly of claim 14, wherein said lid for closing the open side of the cover fits over the bristle head so as to enclose the bristle head within the cover.

17. The toothbrush assembly of claim 14, wherein said lid for closing the open side of the cover is secured to the cover by a snap-fit connection, so as to secure the lid to the cover.

18. The toothbrush assembly of claim 1, further comprising a source of bactericidal radiation in the cover arranged to irradiate the bristles.

19. In combination, the toothbrush assembly of claim 18 and a docking station comprising a power supply for said source of bactericidal radiation and connection means for energizing said source of bactericidal radiation when said toothbrush assembly is returned to said docking station.

20. The toothbrush assembly of claim 1, further comprising an ultrasonic vibratory source disposed in the body of the toothbrush.

21. The toothbrush assembly of claim 20, further comprising batteries for powering said ultrasonic vibratory source.

22. In combination, the toothbrush assembly of claim 21 and a docking station comprising battery charging circuitry and connection means for charging said batteries when said toothbrush assembly is returned to said docking station.

23. The toothbrush assembly of claim 1, wherein said cover comprises a back wall and a continuous side wall joined to the periphery of said back wall, said side wall including opposed sides and opposed ends, and wherein at least the sides of the cover are porous.

24. The toothbrush assembly of claim 1, wherein the body of the toothbrush, the elongated connector, and the bristle cover are molded of one or more plastic materials.

25. The toothbrush assembly of claim 24, wherein said plastic materials are selected from the group consisting of low or high density polyethylene (PE), low or high density polypropylene (PP), and polyvinylchloride (PVC).

26. The toothbrush assembly of claim 1, further comprising means for retaining the cover over the bristle head.

27. The toothbrush assembly of claim 26, wherein said means for retaining the cover over the bristle head comprises a C-shaped clip secured to the elongated connector and adapted to grip the body of the toothbrush and secure the cover over the bristles.

28. The toothbrush assembly of claim 1 wherein the cover includes a drain hole.

29. The toothbrush assembly of claim 1, wherein said lid of the storage compartment is pivotably coupled to the elongated toothbrush body and fits essentially completely flush with a surface of the toothbrush when the lid is closed.

30. The toothbrush of claim 29, wherein protrusions on one of the lid and body of the toothbrush cooperate with recesses formed on the other of the lid and body of the toothbrush so as secure the lid in the closed position, closing the storage compartment.

31. The toothbrush of claim 29, wherein the pivotable coupling between the lid and body of the toothbrush is formed by a hinge.

32. The toothbrush of claim 1, wherein a drainage opening is provided in the storage compartment.

33. The toothbrush assembly of claim 1, wherein said cover and elongated connector are molded as an integral member.

34. A method of protecting bristles of a toothbrush, comprising the steps of:

a. providing a toothbrush assembly, comprising:

an elongated toothbrush body having a bristle head at one end and a handle at a second end, the handle comprising a storage compartment, the storage compartment comprising a lid, wherein the lid is operably coupled to the storage compartment so as to allow the storage compartment to be opened and closed as desired;

a cover comprising an open side enabling the cover to be placed over the bristle head;

an elongated connector comprising a first end pivotably coupled to the toothbrush body between the bristle head and the storage compartment and a second end operably coupled to the cover, whereby the cover is movable between a first position wherein the open side of the cover faces the bristle head and the cover is disposed over the bristles to protect them when not in use and a second position wherein the cover is protected within the storage compartment by closing of the lid when the brush is in use;

means for selectively retaining the cover in the first or second position;

b. when it is desired to employ the brush, removing the cover from the bristle head, pivoting the elongated connector such that the bristle head is disposed in the storage compartment, and closing the lid of the storage compartment; and c. when employment of the brush is complete, opening the lid of the storage compartment, removing the cover from the storage compartment, pivoting the elongated connector so that the open face of the cover is over the bristle head, and securing the cover over the bristle head.

35. The method of claim 34, comprising the further step of treating the toothbrush with an antibacterial solution.

36. The method of claim 34, comprising the further step of treating the cover with an antibacterial solution.

37. The method of claim 36, wherein the antibacterial solution is selected from the group consisting of an aqueous solution of from about 0.01 to about 10 percent by weight hydrogen or isopropanol, and silver-bearing solutions.

38. The method of claim 34, comprising the further step of irradiating the bristles with bactericidal radiation when the cover is placed over the bristle head.

39. A toothbrush assembly, comprising:

an elongated toothbrush body having a bristle head, comprising: a bristle head body having a quantity of bristles extending from one side of said bristle head body, at one end and a handle at a second end, the handle comprising a storage compartment, the storage compartment comprising a lid, wherein the lid is operably coupled to the storage compartment so as to allow the storage compartment to be opened and closed as desired;

a cover comprising an open side enabling the cover to be placed over the bristle head;

whereby the cover is movable between a first position wherein the open side of the cover faces the bristle head and the cover is disposed over the bristles to protect them when not in use and a second position wherein the cover is protected within the storage compartment by closing of the lid when the brush is in use; and means for selectively retaining the cover in the first or second position.

40. The toothbrush assembly of claim 39, wherein said cover is of clam-shell configuration, comprising two mating halves joined at a hinge extending in a direction generally parallel to the axis of elongation of the toothbrush body, whereby to close the cover over the bristle head the user urges the two mating halves together.

41. The toothbrush assembly of claim 40, wherein one of said two mating halves of said clam-shell cover comprises a hook fitting over the bristle head to secure the cover thereover.

42. The toothbrush assembly of claim 39, wherein said cover comprises a back wall conforming to the peripheral shape of said bristle head and a side wall extending from said back wall for a distance sufficient to enclose said bristle head, and a lid pivoted to said side wall, whereby to close the cover over the bristle head the user disposes the bristle head body in juxtaposition to the back wall of the cover, such that the side wall is disposed around said bristle head body and said bristles, and closes the lid over said bristles.

* * * * *